US007452065B2

(12) United States Patent
Ogawa

(10) Patent No.: US 7,452,065 B2
(45) Date of Patent: Nov. 18, 2008

(54) INK BUBBLE REMOVAL FROM INK JET PRINTER

(75) Inventor: Mikio Ogawa, Nagoya (JP)

(73) Assignee: Brother Kogyo Kabushi Kaisha (JP)

( * ) Notice: Subject to any disclaimer, the term of this patent is extended or adjusted under 35 U.S.C. 154(b) by 506 days.

(21) Appl. No.: 11/072,278

(22) Filed: Mar. 7, 2005

(65) Prior Publication Data

US 2005/0195246 A1 Sep. 8, 2005

(30) Foreign Application Priority Data

Mar. 8, 2004 (JP) ..... P2004-064568

(51) Int. Cl.
*B41J 2/19* (2006.01)

(52) U.S. Cl. ..... 347/92; 347/23; 347/29

(58) Field of Classification Search ..... 347/5, 347/6, 17, 22, 25, 29, 30, 32, 33, 34, 92–94, 347/84–87

See application file for complete search history.

(56) References Cited

U.S. PATENT DOCUMENTS 5,774,141 A * 6/1998 Cooper et al. ..... 347/34
5,812,155 A 9/1998 Seccombe ..... 347/6
6,007,184 A * 12/1999 Terasawa et al. ..... 347/50
6,036,305 A 3/2000 Nagasaki et al. ..... 347/86
7,131,720 B2 * 11/2006 Mizuno et al. ..... 347/92

FOREIGN PATENT DOCUMENTS

EP 1 359 026 A 11/2003
JP 2000-103084 4/2000

OTHER PUBLICATIONS

Office Action dated Sep. 29, 2006 in Chinese Application No. 200510052751.9.

* cited by examiner

*Primary Examiner*—Juanita D Stephens
(74) *Attorney, Agent, or Firm*—Banner & Witcoff, Ltd.

(57) ABSTRACT

An ink jet printer includes a carriage movable on a body frame, including at least one printing head; an ink tank that stores the ink; and an ink path that supplies the ink from the ink tank to the printing head. The carriage has a bubble collecting chamber that collects bubbles produced in the ink path, a discharge path which is communicated with the bubble collecting chamber, and an opening and closing valve which is arranged in the discharge path and is normally closed. The body frame has a member for opening and closing the opening and closing valve, a discharge cap which can be brought into tight contact with the carriage to close an outlet of the discharge path so that an airtight space communicated with the outlet is defined between the discharge cap and the carriage, and a suction member that sucks air from the airtight space.

21 Claims, 23 Drawing Sheets

INK BUBBLE REMOVAL FROM INK JET PRINTER

BACKGROUND OF THE INVENTION

1. Field of the Invention

The present invention relates to an ink jet printer, and more particularly, to an ink jet printer which is constructed to collect bubbles produced in an ink path to thereby maintain good printing quality and to efficiently remove collected bubbles.

2. Description of the Related Art

So far, ink jet printers of a tube supply type in which ink is supplied from an ink tank fixed to a body of the ink jet printer through a flexible tube to a printing head equipped to a moving carriage have been disclosed in JP-A-2000-103084 (see FIG. 1, etc.), and so forth.

In the ink jet printer disclosed in JP-A-2000-103084 (see FIG. 1, etc.), a bubble collecting chamber (referred to as a "manifold" in the publication gazette) is defined at an upper part of a printing head, and an ink tank and a circulation pump are fixedly maintained. By actuating the circulation pump, ink is circulated from the ink tank through a first ink path, the bubble collecting chamber and a second ink path to the ink tank. The bubbles existing in this circulation course are directed to and removed at the ink tank. In a maintenance position of the carriage, ink is sucked from a nozzle (an ink jetting side) of the printing head by suction purge member.

SUMARY OF THE INVENTION

However, the construction disclosed in JP-A-2000-103084 (see FIG. 1, etc.) suffers from defects in that, since the ink tank is opened to the atmosphere, when circulating ink, air (bubbles) is likely to be entrained in the ink, thereby deteriorating bubble removal efficiency.

Accordingly, the present invention has been made to solve the above-mentioned problem. It is an object of the present invention to efficiently remove bubbles collected in a bubble collecting chamber.

According one aspect of the invention, an ink jet printer includes: a carriage movable on a body frame, including at least one printing head that prints data on a printing medium by jetting ink through a nozzle; an ink tank that stores the ink to be supplied to a printing head; and an ink path that supplies the ink from the ink tank to the printing head. The carriage has a bubble collecting chamber that collects bubbles produced in the ink path, a discharge path which is communicated with the bubble collecting chamber, and an opening and closing valve which is arranged in the discharge path and is normally closed. The body frame has an opening and closing member for opening and closing the opening and closing valve, a discharge cap which can be brought into tight contact with the carriage to close an outlet of the discharge path so that an airtight space communicated with the outlet is defined between the discharge cap and the carriage, and a suction member that sucks air from the airtight space.

When discharging the bubbles (air) collected in the bubble collecting chambers, the discharge cap is brought into tight contact with the carriage to define the airtight space, the opening and closing valves are opened by the opening and closing members to communicate the bubble collecting chambers with the airtight space, and the air existing in the airtight space is sucked by the suction member to be discharged to the atmosphere. During discharge of the bubbles, air flows from the bubble collecting chambers through the airtight space and the suction member to the atmosphere to constitute a unidirectional flow pattern. By this fact, the possibility of outside air to enter the bubble collecting chambers or the ink paths is eliminated, and it is possible to prevent air from being entrained in the ink. Also, when compared to the method in which a negative pressure is induced from the nozzle side of the printing head to suck ink and thereby remove bubbles entrained in the ink, it is possible to avoid waste of ink and to shorten a time for removing bubbles. Further, if air is sucked through the nozzles, air which is not sucked and remains may not be discharged to the outside. The embodiment of the invention reliably prevents this situation from occurring.

According to another aspect of the invention, a valve opening operation of the opening and closing valve by the opening and closing member is implemented in a state in which the discharge cap is brought into tight contact with the carriage and thereby the airtight space is defined between the discharge cap and the carriage.

By thus configuration, the valve opening operation of the opening and closing valves by the opening and closing members is effected in a state in which the discharge cap is brought into tight contact with the carriage to define the airtight space, as the discharge paths of the bubbles are shut off from the atmosphere, entrainment of atmospheric air into the bubble collecting chambers is prevented. By this fact, it is possible to prevent the ink from flowing backward to the ink tanks due to pressure rises in the bubble collecting chambers.

According to another aspect of the invention, the valve opening operation of the opening and closing valve by the opening and closing member is implemented in a state in which a negative pressure is induced by the suction member in the airtight space defined due to the tight contact of the discharge cap with the carriage.

In the case that the bubble collecting chambers have pressures which are lower than the atmospheric pressure and there exist water head differences between the printing heads and the ink tanks, if the opening and closing valves are opened while the airtight space has the atmospheric pressure, the air existing in the airtight space is introduced into the bubble collecting chambers to increase pressures of the bubble collecting chambers, and ink flows backward from the printing heads to the ink tanks, whereby colors of ink may be mixed due to the ink remaining in the discharge cap. However, because the opening and closing valves are opened in a state in which a negative pressure is induced in advance in the airtight space, the bubble collecting chambers are maintained under the negative pressure, and the ink is prevented from flowing backward toward the ink tanks.

According to another aspect of the invention, the opening and closing member is formed in a rod shape. The opening and closing member passes through the discharge cap. The discharge cap is formed of silicon rubber.

By thus configuration, the discharge cap is formed of silicon rubber, airtightness of the airtight space is ensured, and sliding resistances between the discharge cap and the opening and closing members can be decreased.

According to another aspect of the invention, a nozzle cap which can be brought into tight contact with the carriage to cover the nozzle of the printing head is provided. Discharge of bubbles by the suction member is implemented in a state in which the printing head is shut off from the atmosphere due to the tight contact of the nozzle cap with the carriage.

If the bubbles are discharged with the printing heads opened to the atmosphere, meniscuses are likely to be destroyed due to falls in pressures of the bubble collecting chambers. However, since discharge of the bubbles is implemented in a state in which the printing heads are shut off from the atmosphere due to tight contact of the nozzle cap with the carriage, it is possible to prevent the meniscuses from being destroyed.

According to another aspect of the invention, the carriage has a plurality of printing heads. Each printing head has a discharge path which extends from a bubble collecting chamber to outlets. Each discharge path having different bubble discharge resistance when bubbles collected in the bubble collecting chamber are discharged. Discharge of bubbles by the suction member is independently implemented for each printing head.

In the case that the printing heads possess different discharge resistances due to differences in the number of nozzles, diameter of the nozzle, and diameter of the ink path, and length of the ink path, if the bubble discharging operation is simultaneously implemented for the plurality of printing heads having different discharge resistances, a deviation may be caused in bubble discharge amounts of the respective printing heads. In this consideration, since discharge of the bubbles by the suction member is independently implemented for each of the printing heads, it is possible to prevent a deviation from being caused in bubble discharge amounts of the respective printing heads.

According to another aspect of the invention, the carriage has a plurality of printing heads. Each printing head has a discharge path which extends from a bubble collecting chamber to outlets. Each discharge path having same bubble discharge resistance when bubbles collected in the bubble collecting chamber are discharged. Discharge of bubbles by the suction member is simultaneously implemented for the plurality of printing heads.

Because discharge of the bubbles is simultaneously implemented for the printing heads which possess the same discharge resistance, it is possible to constantly maintain a bubble discharge amount in the respective printing heads and efficiently discharge the bubbles.

According to another aspect of the invention, a switching member switches the airtight space between a state in which the airtight space is communicated with the suction member and a state in which the airtight space is shut off from the suction member. A cam moves the opening and closing member between a valve opening position in which the opening and closing valve is opened and a valve closing position in which the opening and closing valve is closed. The switching member and the cam are configured to be simultaneously operated.

Due to the fact that the switching member and the cam are configured to be simultaneously operated, the operation for opening and closing the opening and closing valve by the opening and closing member moved due to operation of the cam and the operation for sucking bubbles by the suction member switched by the switching member can be implemented with precise timing. Since a separate mechanism for synchronizing the operation of the opening and closing member and the bubble suction operation is not needed, structural simplification can be ensured.

According to another aspect of the invention, a nozzle cap which can be brought into tight contact with the carriage to cover the nozzle of the printing head so that a closed space facing the printing head is defined between the nozzle cap and the carriage is provided. The switching member is configured to switch the closed space between a state in which the closed space is communicated with the suction member and a state in which the closed space is shut off from the suction member.

Due to the fact that the switching member and the cam are configured to be simultaneously operated, in addition to the operation for opening and closing the opening and closing valve by the opening and closing member moved due to operation of the cam and the operation for sucking bubbles by the suction member switched by the switching member, the operation for sucking ink which blocks a passage defined in the nozzle can be implemented with precise timing.

According to another aspect of the invention, a wiper is operated by the cam between a position in which the wiper can wipe ink attached to the nozzle of the printing head and a position in which the wiper is not brought into contact with the nozzle of the printing head. A carriage lock holds by the cam the carriage in a maintenance position in which the bubbles can be discharged from the bubble collecting chamber. The opening and closing member, the wiper and the carriage lock are located on one surface of a partition wall. The switching member is located on the other opposite surface of the partition wall.

The opening and closing members, the wiper, and the carriage lock which are driven by the cam are located on one surface of a partition wall, and the switching member is located on the other surface of the partition wall. By this fact, the task for laying out tubes which extend from the switching member to the suction member, the airtight space, and the closed space can be easily conducted.

According to another aspect of the invention, a cover has the switching member. The cover has a port that discharges and sucks air. The switching member is configured to have a switching path which can be communicated with the port of the cover. The switching member is slidable on an inner surface of the cover while maintaining airtightness.

When the cam is stopped immediately after driving the driven parts such as the opening and closing members and so forth, due to loads applied to the cam from the driven parts, the cam is likely to be stopped at a position which is deviated from a predetermined position. To cope with this problem, since the switching member which is rotated integrally with the cam is configured to generate frictional resistance due to sliding rotation with respect to the cover, by the presence of the frictional resistance, it is possible to reliably stop the valve bodies and the cam at predetermined positions.

When the cam is stopped immediately after driving the driven parts such as the opening and closing members and so forth, due to loads applied to the cam from the driven parts, the cam is likely to be stopped at a position which is deviated from a predetermined position. To cope with this problem, since the switching member which is rotated integrally with the cam is configured to generate frictional resistance due to sliding rotation with respect to the cover, by the presence of the frictional resistance, it is possible to reliably stop the valve bodies and the cam at predetermined positions.

According to another aspect of the invention, the switching member and the cam are rotatingly driven by a gear. The cover is held, through engagement by engagement clips, in a state in which the cover can be relatively rotated with respect to the cam and cannot be moved in an axial direction. The cover is prevented from being directly rotated by fitting an arm formed with the cover around a shaft of the bear.

In order to fix the positions of the ports with respect to the switching member which rotates, the cover must be certainly restrained from being rotated. As a rotation restraining member, the shaft of the gear is used in an embodiment of the invention. Therefore, when compared to the case of providing a dedicated fixing member, structural simplification can be ensured. Also, since the cover held by the cam can be relatively rotated with respect to the cam, rotation of the cam and the switching member is not adversely affected.

According to another aspect of the invention, the opening and closing member is configured to be capable of being moved from the valve closing position for closing the opening and closing valve to the valve opening position for opening the opening and closing valve while being inserted into the discharge path in a direction crossed with a direction in which the carriage is moved. When the carriage is in a printing region for printing data on the printing medium, the opening and closing member is held in the valve closing position. When the carriage is moved to a maintenance position in which the bubbles can be discharged from the bubble collecting chamber, the opening and closing member is allowed to be moved to the valve opening position.

While the carriage is not positioned in the maintenance position, since the opening and closing members are held withdrawn to the valve closing position, it is possible to prevent the carriage from being moved to the maintenance position and interfering with the opening and closing members while the opening and closing members are in the valve opening position.

According to another aspect of the invention, the carriage is movable between the printing region for printing data on the printing medium and the maintenance position for discharging bubbles from the bubble collecting chamber. The discharge cap is movable between a tight contact position in which the discharge cap is brought into tight contact with the carriage and a standby position in which the discharge cap is not brought into contact with the carriage. The carriage is configured to move the discharge cap from the standby position to the tight contact position while the carriage is moved from the printing region to the maintenance position.

Although a member for synchronizing the movement of the carriage with the movement of the discharge cap is not provided, if the carriage is moved toward the maintenance position, in conformity with the movement of the carriage, it is possible to bring the discharge cap into tight contact with the carriage with proper timing. Also, since the carriage is configured to push the discharge cap, a dedicated driving source for moving the discharge cap is not needed.

According to another aspect of the invention, the carriage is movable between the printing region for printing data on the printing medium and the maintenance position for discharging bubbles from the bubble collecting chamber. The nozzle cap is movable between a tight contact position in which the nozzle cap is brought into tight contact with the carriage and a standby position in which the nozzle cap is not brought into contact with the carriage. The carriage is configured to move the nozzle cap from the standby position to the tight contact position while the carriage is moved from the printing region to the maintenance position.

Although a member for synchronizing the movement of the carriage with the movement of the nozzle cap is not provided, if the carriage is moved toward the maintenance position, in conformity with the movement of the carriage, it is possible to bring the nozzle cap into tight contact with the carriage at proper timing. Also, since the carriage is configured to push the nozzle cap, a dedicated driving source for moving the nozzle cap is not needed.

DESCRIPTION OF THE PREFERRED EMBODIMENTS

First Embodiment

Hereinafter, a first embodiment of the present invention will be described with reference to FIGS. 1 through 23.

<Entire Construction>

Figure 1:
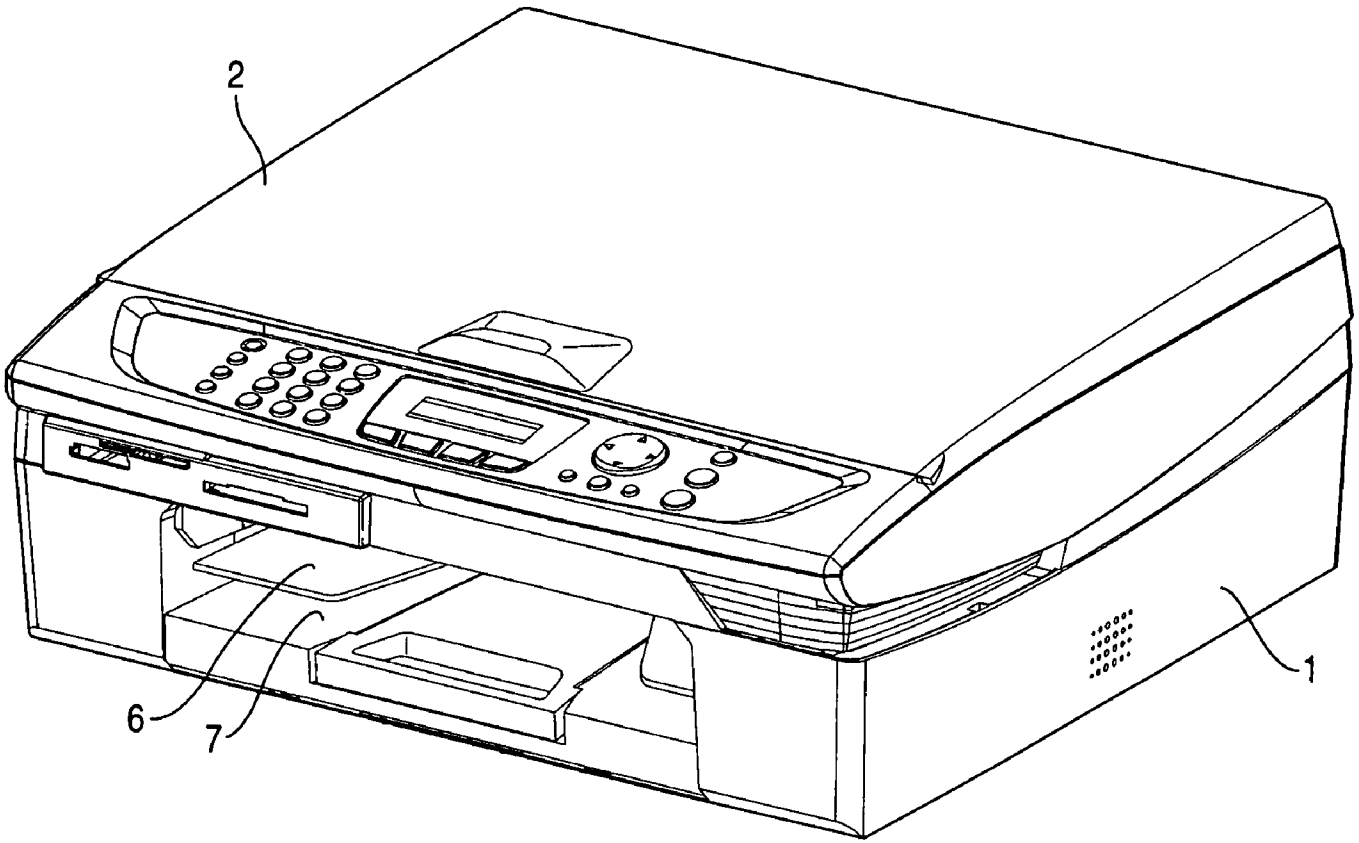
FIG. 1 is a perspective view illustrating an outer appearance of an ink jet printer.
Figure 2:
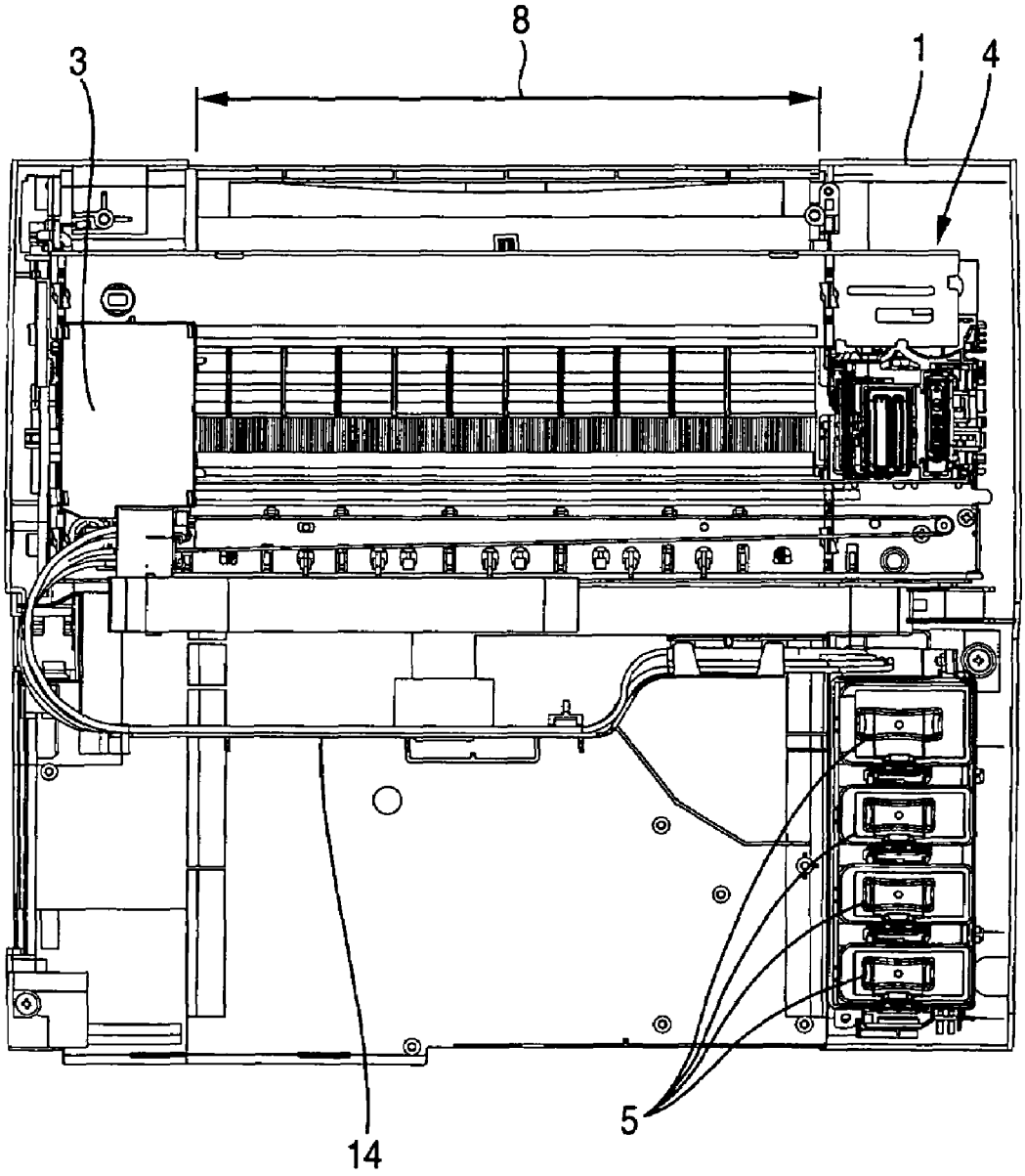
FIG. 2 is a plan view illustrating an entire construction of an internal mechanism.

An ink jet printer according to this embodiment of the present invention has a printer function, a copier function and a scanner function. As shown in FIGS. 1 and 2, a paper discriminating device 2 for the copier function and the scanner function is arranged on the upper surface of a body frame 1. Below the paper discriminating device 2, there are arranged a carriage 3 for printing operation, a maintenance unit 4 for unclogging printing heads 10 as will be described below, and ink tanks 5 for supplying ink to the printing heads 10. On the front surface of the body frame 1, there are arranged a paper discharging tray 6 and a paper feeding tray 7. The carriage 3 is configured to be reciprocatingly moved in leftward and rightward directions. A printing region 8 is defined to extend from the left end of a moving path of the carriage 3 to a position which is adjacent to a right end of the moving path of the carriage 3, and a maintenance position (an origin position or a home position) is defined at the right end of the moving path of the carriage 3. The maintenance unit 4 is provided to the maintenance position. In front of (just forward of) the maintenance position, the ink tanks (ink cartridges) 5 for black, cyan, magenta and yellow are disposed in a side-by-side relationship.

<Carriage 3, and Member for Supplying Ink to Carriage 3>

Figure 23:
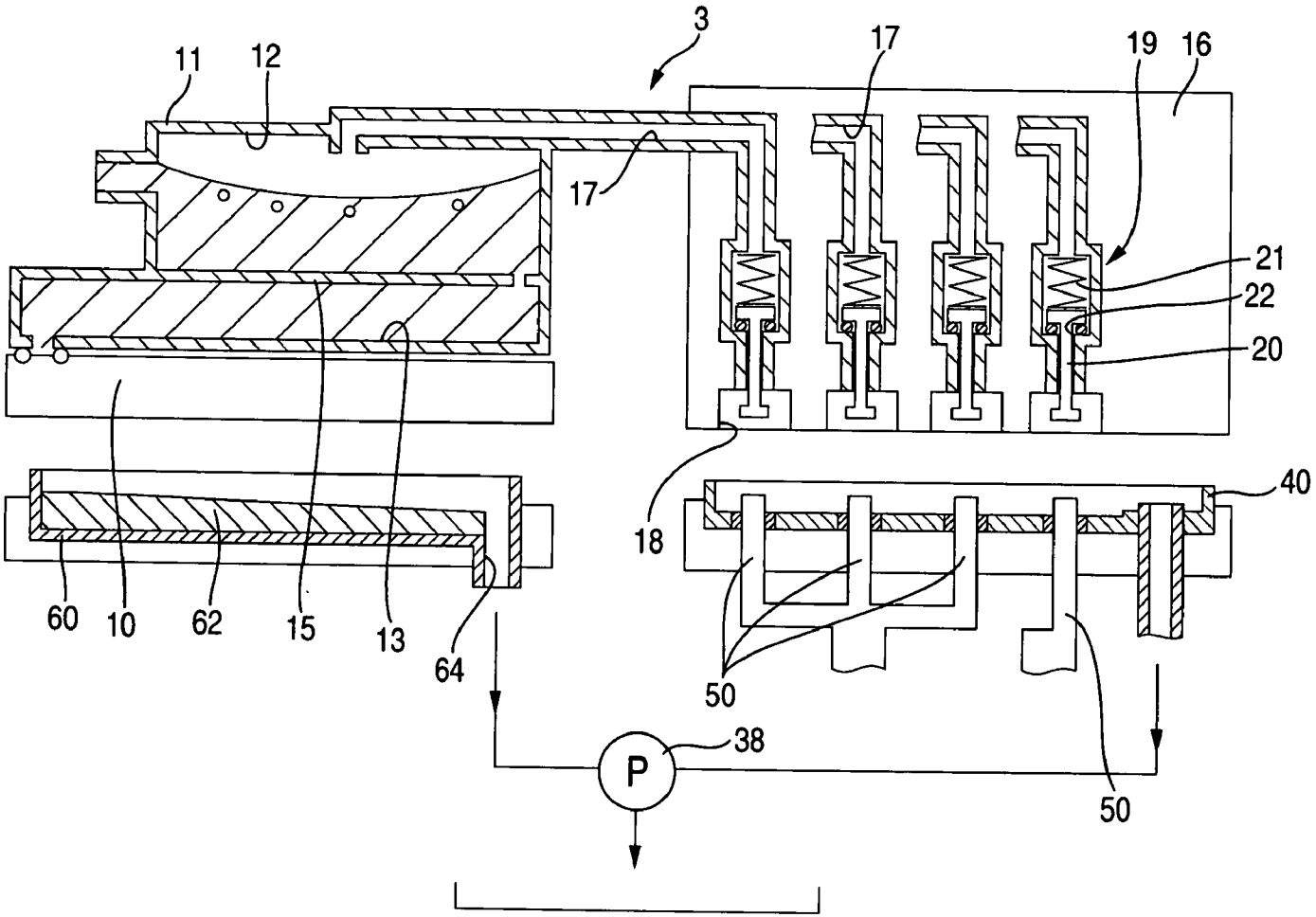
FIG. 23 is a schematic sectional view of the carriage.

As shown in FIG. 23, the carriage 3 has four printing heads 10 each of which possesses a plurality of nozzles on a lower surface thereof. While the carriage 3 is moved along the printing region 8, ink is jetted from the nozzles of the respective printing heads 10 to print data on a printing medium (paper). The nozzles of the printing head 10 for black are located in the rectangular area which extends in forward and rearward directions. The printing heads 10 for colors, that is, cyan, magenta and yellow, are located in a side-by-side relationship in an area which is defined leftward of the nozzles for black. The numbers of nozzles for respective cyan, magenta and yellow are the same, and the number of nozzles for black is greater than the number of nozzles for each of cyan, magenta and yellow.

A buffer tank 11 is provided on the upper surface of each printing head 10. The buffer tank 11 has at an upper portion thereof a bubble collecting chamber 12 and at a lower portion thereof an ink chamber 13 which is communicated with the printing head 10. Ink is supplied to the bubble collecting chamber 12 from the ink tank 5 through a flexible tube 14 (see FIG. 2). The ink supplied to the bubble collecting chamber 12 flows into the ink chamber 13 through a filter 15 to reach the printing head 10. When ink passes through the filter 15, bubbles contained in the ink are separated from the ink to be collected in the upper portion of the bubble collecting chamber 12.

In the carriage 3, there is provided a valve case 16 which is positioned at the right side of the printing heads 10. Outlets 18 of discharge paths 17 which extend from the upper walls of the respective bubble collecting chambers 12 are opened at the lower surface of the valve case 16. These outlets 18 are arranged in the forward and rearward directions. The four discharge paths 17 extend in the valve case 16 in upward and downward directions, and normally closed type opening and closing valves 19 are installed in the discharge paths 17, respectively. Each opening and closing valve 19 is normally closed due to the fact that a valve body 20 which is slim and extends in the upward and downward directions closes a valve opening 22 under the influence of a spring 21. If the valve body 20 is moved upward against a biasing force of the spring 21, the opening and closing valve 19 is opened. Discharge passages (as will be described later in detail) for colors, that is, cyan, magenta and yellow, each of which extends from the bubble collecting chamber 12 to the outlet 18 of the discharge path 17 have the same discharge resistance. On the other hand, a discharge passage for black has a discharge resistance which is less than that for the colors.

The carriage 3 constructed in this way can be stopped in the course of its reciprocating passage at the origin position which is defined at the right end of the reciprocating passage, an idle suction position which is defined slightly leftward of (toward the printing region 8 from) the origin position and rightward of a wiper 90, and a wiping end position which is defined slightly leftward of the wiper 90.

<Driving Force Transmitting Mechanism of Maintenance Unit 4>

Figure 3:
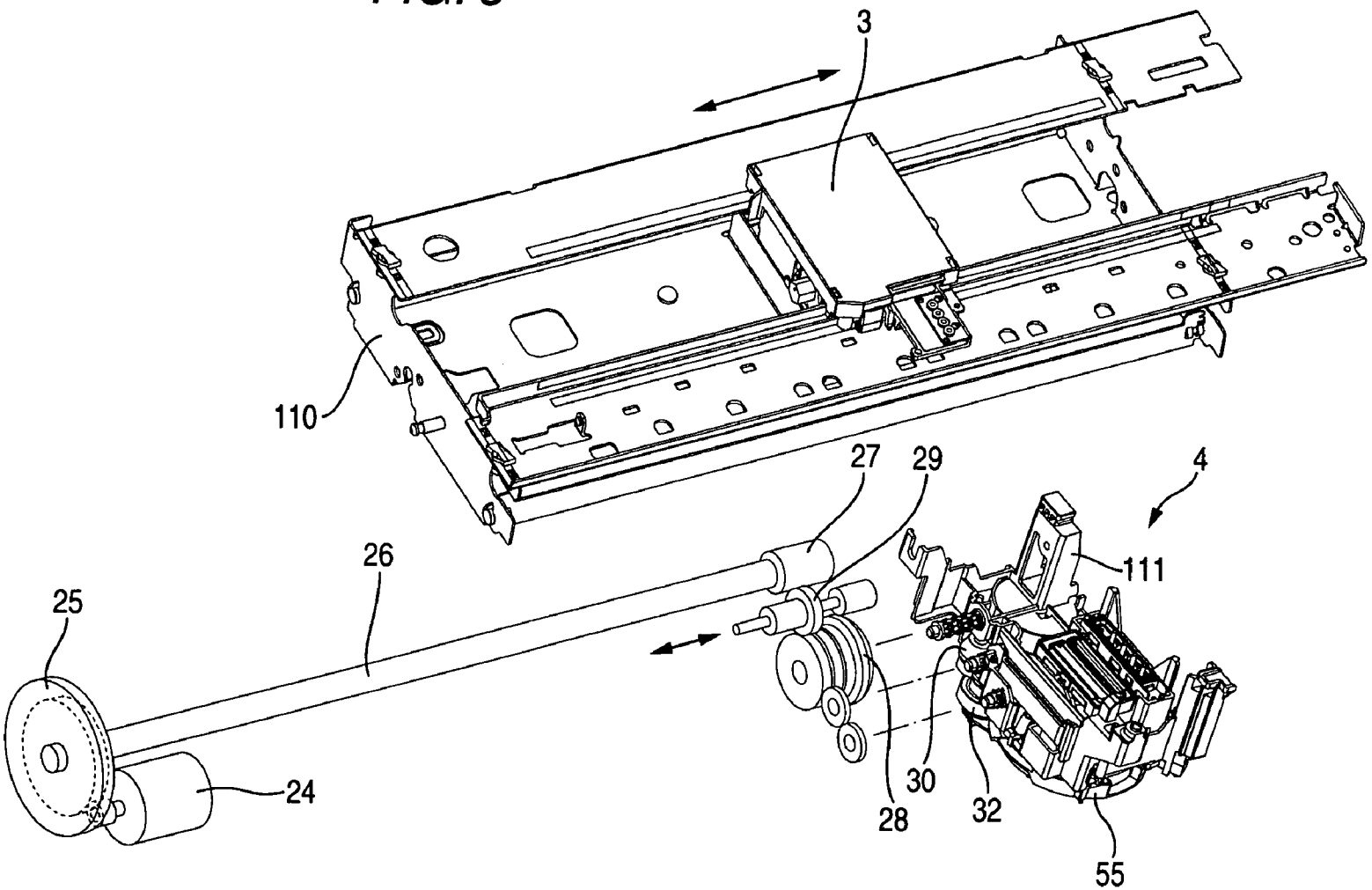
FIG. 3 is a perspective view illustrating a mechanism for transmitting a rotational driving force to a maintenance mechanism.
Figure 4:
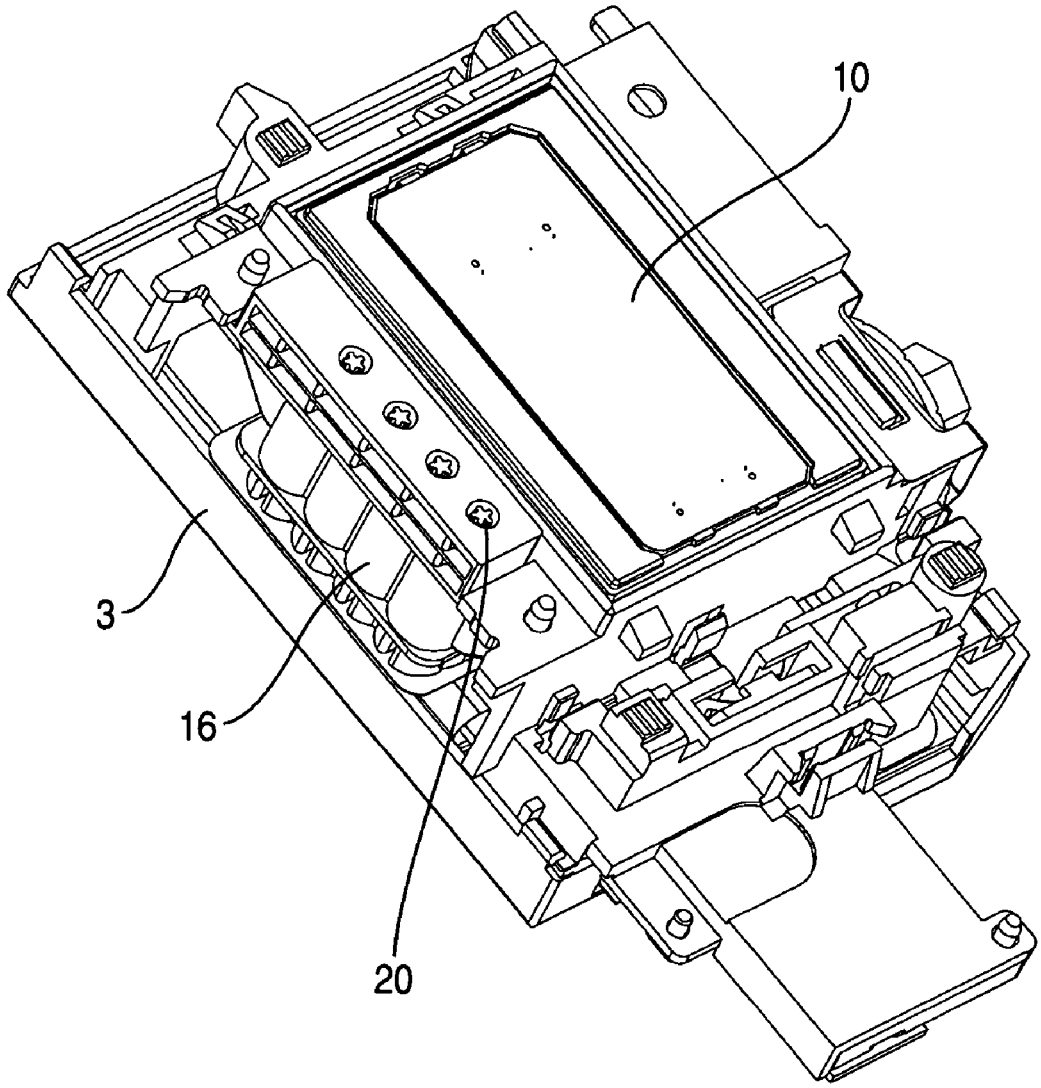
FIG. 4 is a perspective view illustrating an inverted state of a carriage.

Referring to FIG. 3, a carriage frame 110 is provided with a rotation driving mechanism which includes a motor 24 positioned at the left end of the carriage frame 110, as a member that rotates a paper feeding roller (not shown). A rotation shaft 26 of a reduction gear 25 which is meshed with an output shaft of the motor 24 extends rightward, and a driving gear 27 is provided to the right end of the rotation shaft 26 to be rotated integrally with the rotation shaft 26. A slide gear 29 is meshed with the driving gear 27. The slide gear 29 is meshed with a large-diameter bevel gear 28 only when the carriage 3 is moved to the maintenance position. The large-diameter bevel gear 28 is meshed with a small-diameter bevel gear 30 of which axis extends in the upward and downward directions.

Figure 5:
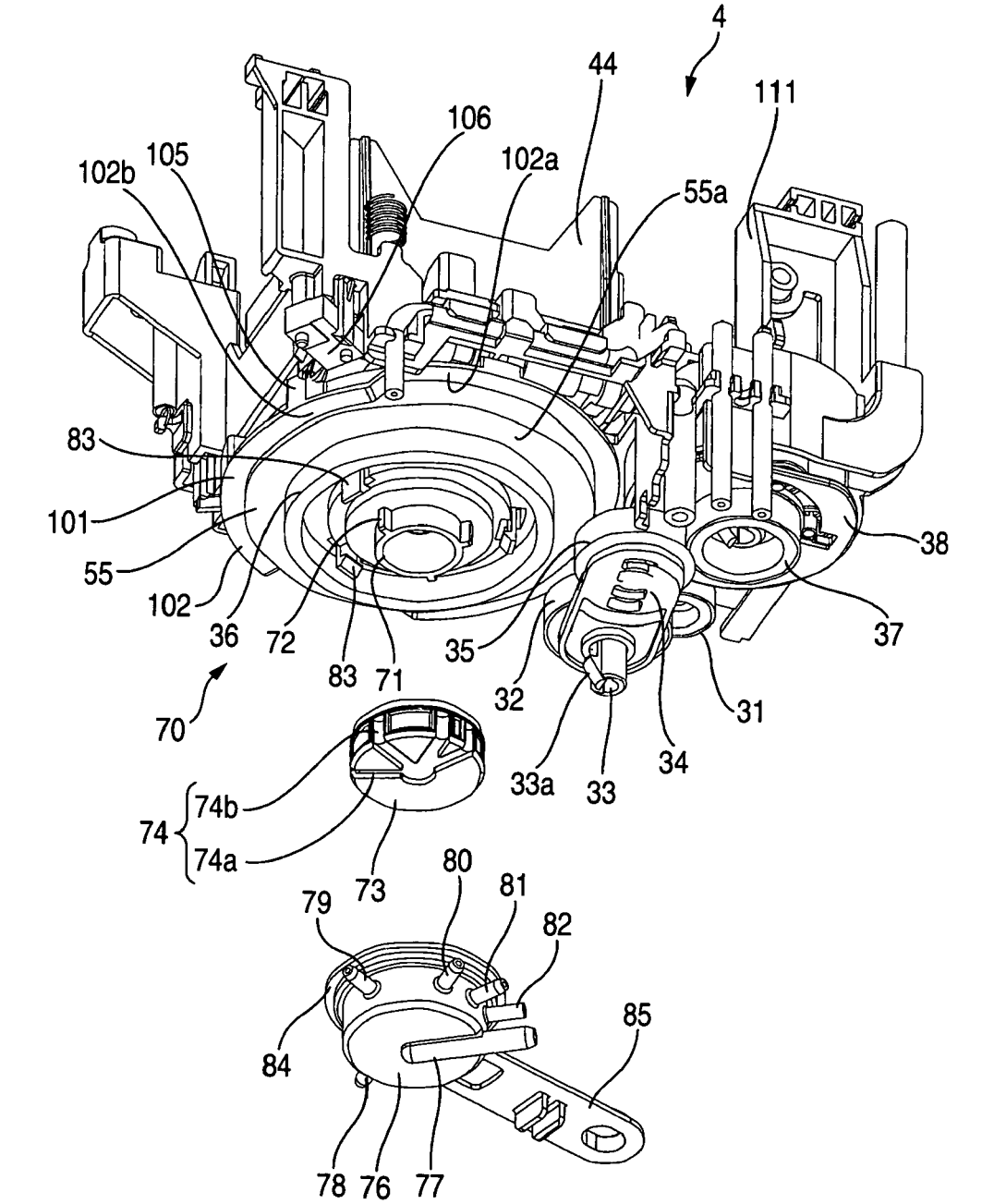
FIG. 5 is a perspective view taken by viewing the maintenance mechanism from the bottom.
Figure 6:
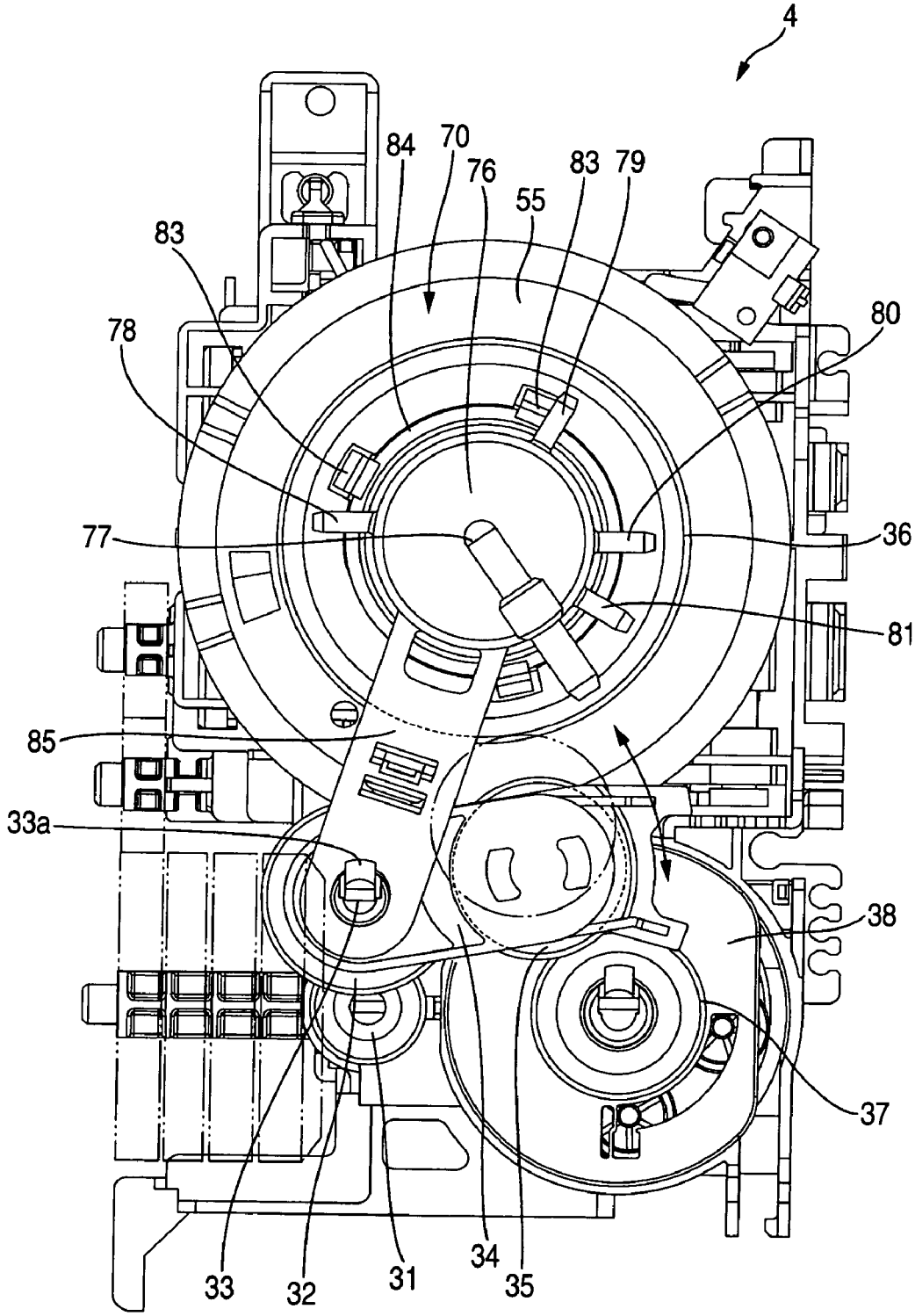
FIG. 6 is a bottom view of the maintenance mechanism.
Figure 7:
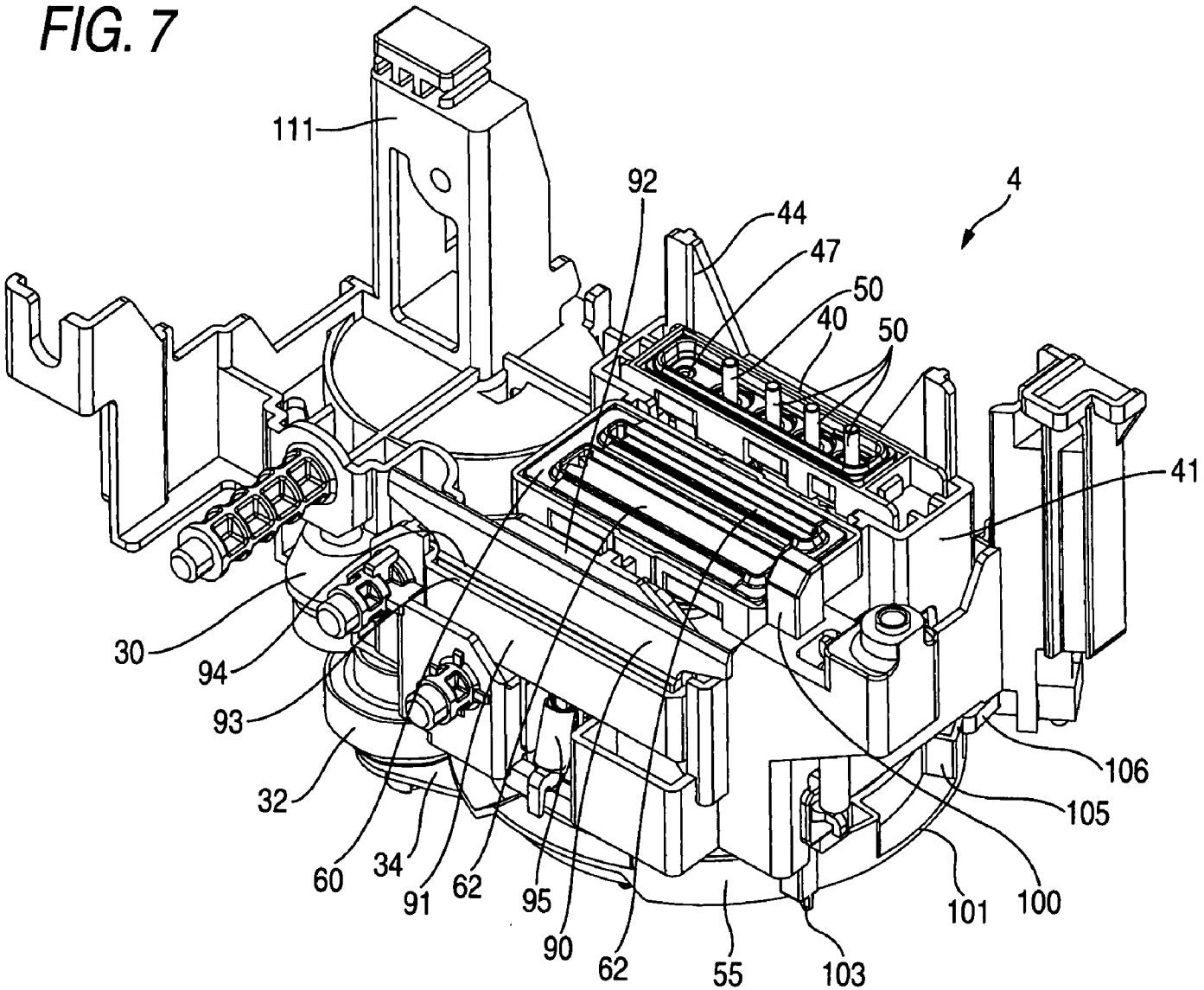
FIG. 7 is a top perspective view of the maintenance mechanism.

The small-diameter bevel gear 30 is meshed with a sun gear 32 by way of a reduction gear 31. As shown in FIGS. 5 and 6, one end of a pivot arm 34 is rotatably fitted around the shaft 33 of the sun gear 32. A planetary gear 35 which is meshed with the sun gear 32 is rotatably connected to the other end of the pivot arm 34. In front of the planetary gear 35, a disc-shaped cam 55 having an axis which extends parallel to the sun gear 32 and the planetary gear 35, that is, in the upward and downward directions, is rotatably supported by a maintenance frame 111. A driven gear 36 which has the same height as the planetary gear 35 is formed integrally with the cam 55. The cam 55 will be described later in detail.

On the other hand, behind the planetary gear 35, a pump gear 37 which has the same height as the planetary gear 35 is rotatably supported by the maintenance frame 111. If the pump gear 37 is rotated, a rotary type pump 38 (as a suction member according to one embodiment of the invention) is driven to implement sucking operation.

If the sun gear 32 is rotated in a counterclockwise direction in FIG. 6 as will be described below, the planetary gear 35 revolves around the sun gear 32 in the counterclockwise direction to be meshed with the driven gear 36 of the cam 55, and the cam 55 is rotatingly driven in the counterclockwise direction (a clockwise direction when viewed from the top). On the contrary, if the sun gear 32 is rotated in the clockwise direction, the planetary gear 35 revolves around the sun gear 32 in the clockwise direction to be meshed with the pump gear 37, and the pump 38 is rotatingly driven to implement the sucking operation. Accordingly, the rotation of the cam 55 is always effected in the counterclockwise direction in FIG. 6 (the clockwise direction in FIGS. 12 and 13).

<Discharge Cap 40 of Maintenance Unit 4>

Figure 8:
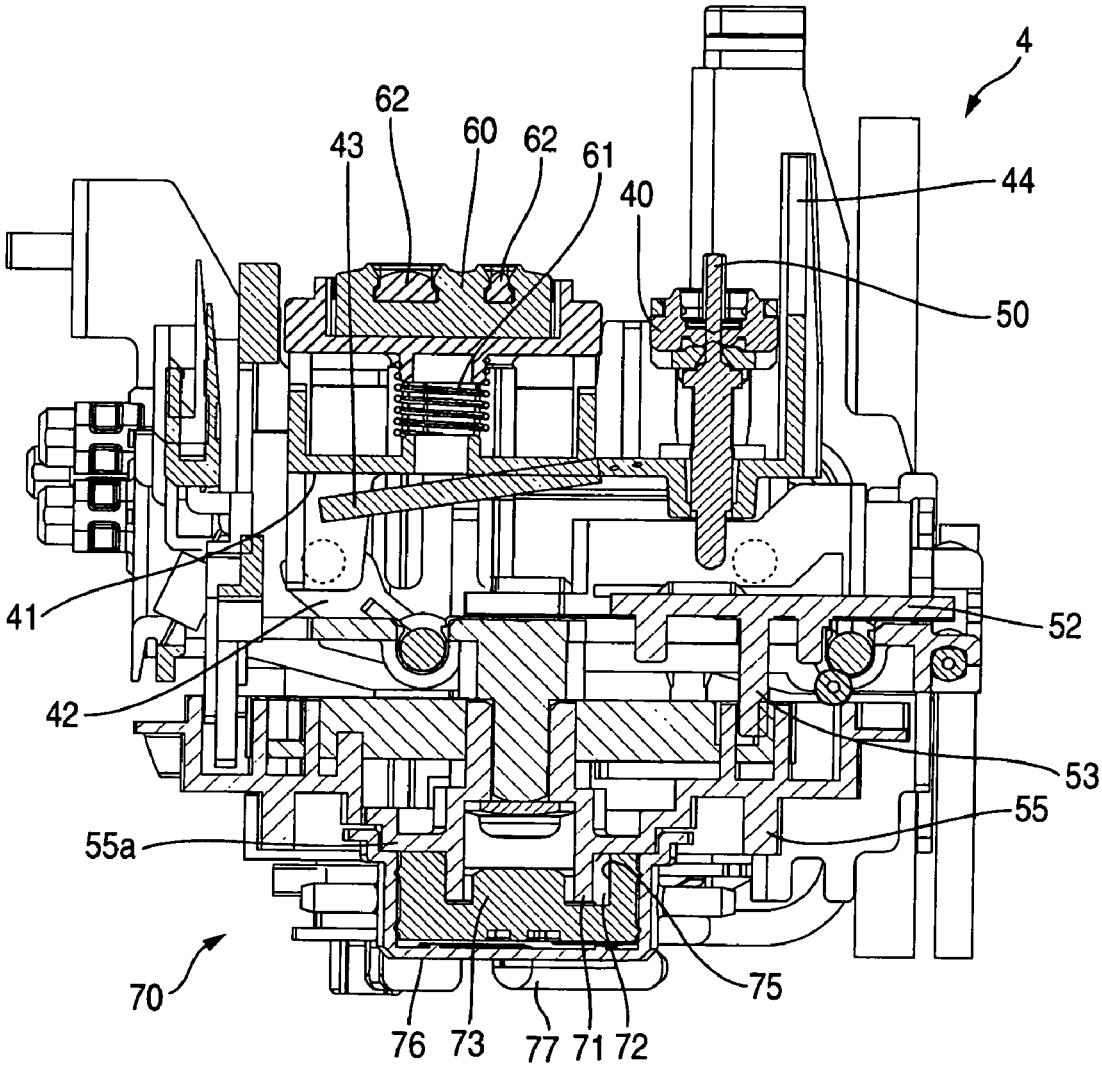
FIG. 8 is a schematic sectional view illustrating a state in which caps are in a standby position, opening and closing members are in a valve closing position, and a wiper is in a retracted position.
Figure 9:
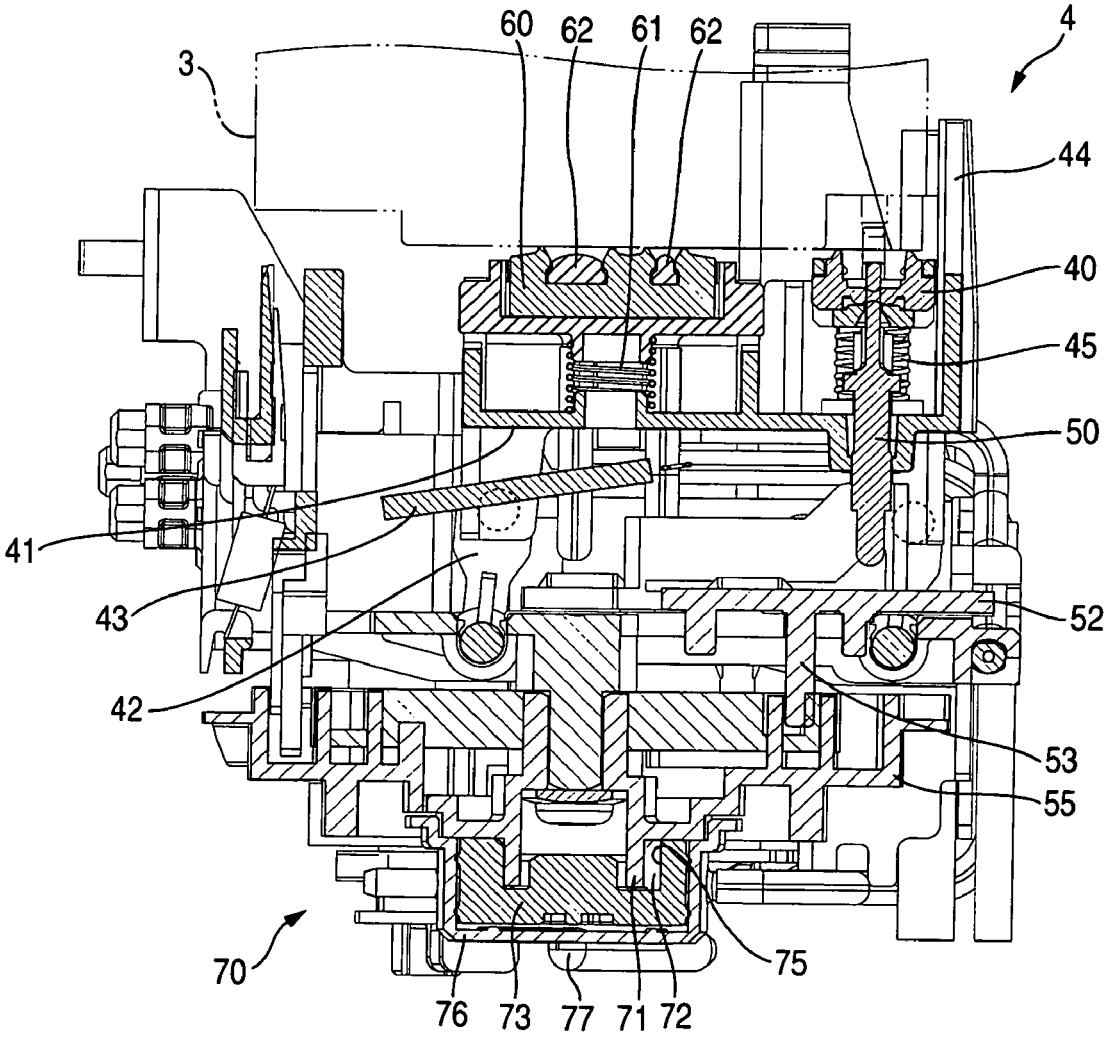
FIG. 9 is a schematic sectional view illustrating a state in which the carriage is in an origin position and the caps are brought into tight contact with the carriage.
Figure 10:
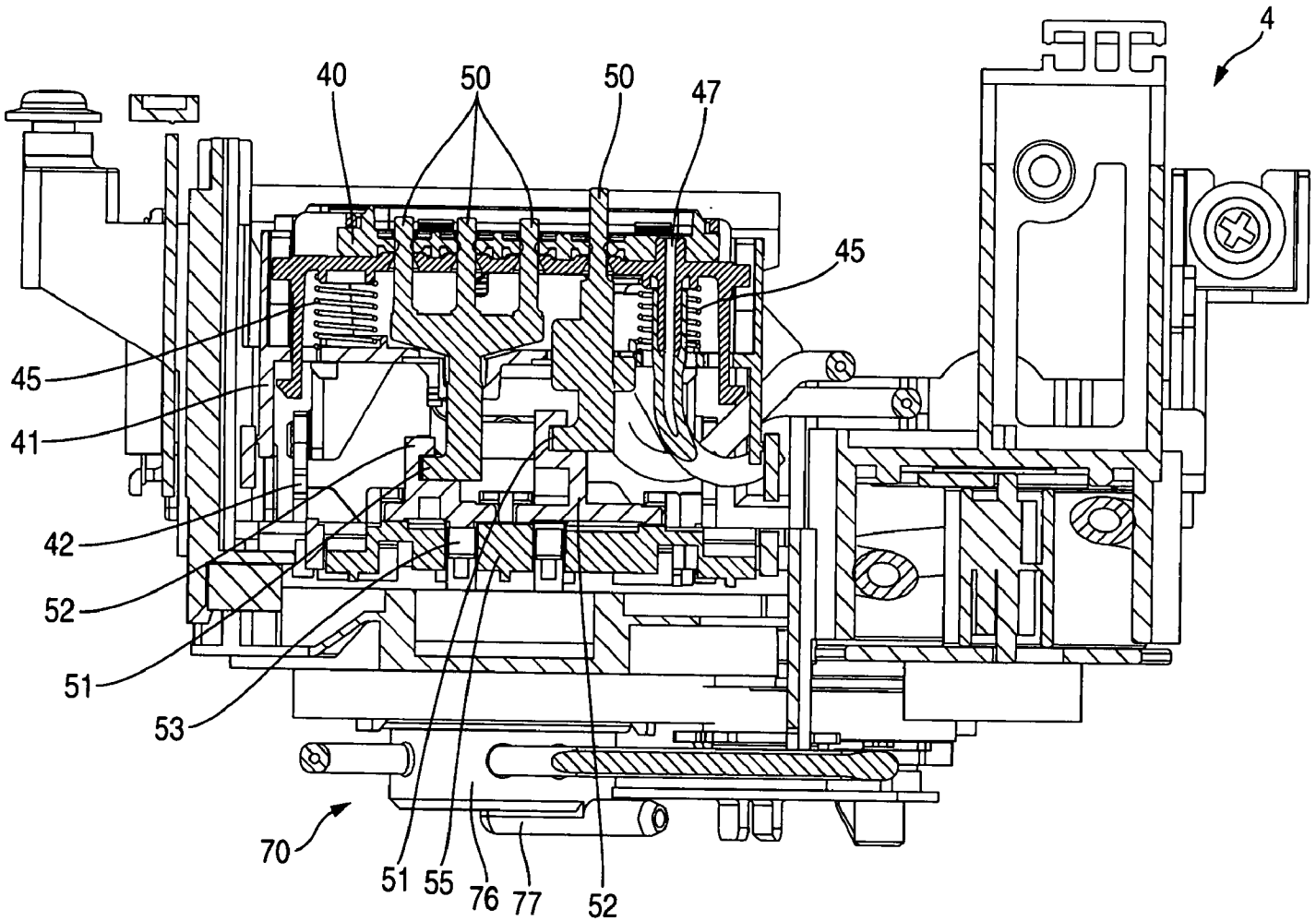
FIG. 10 is a schematic sectional view illustrating a state in which the opening and closing member for black is in a valve opening position and the opening and closing members for colors are in a valve closing position.
Figure 11:
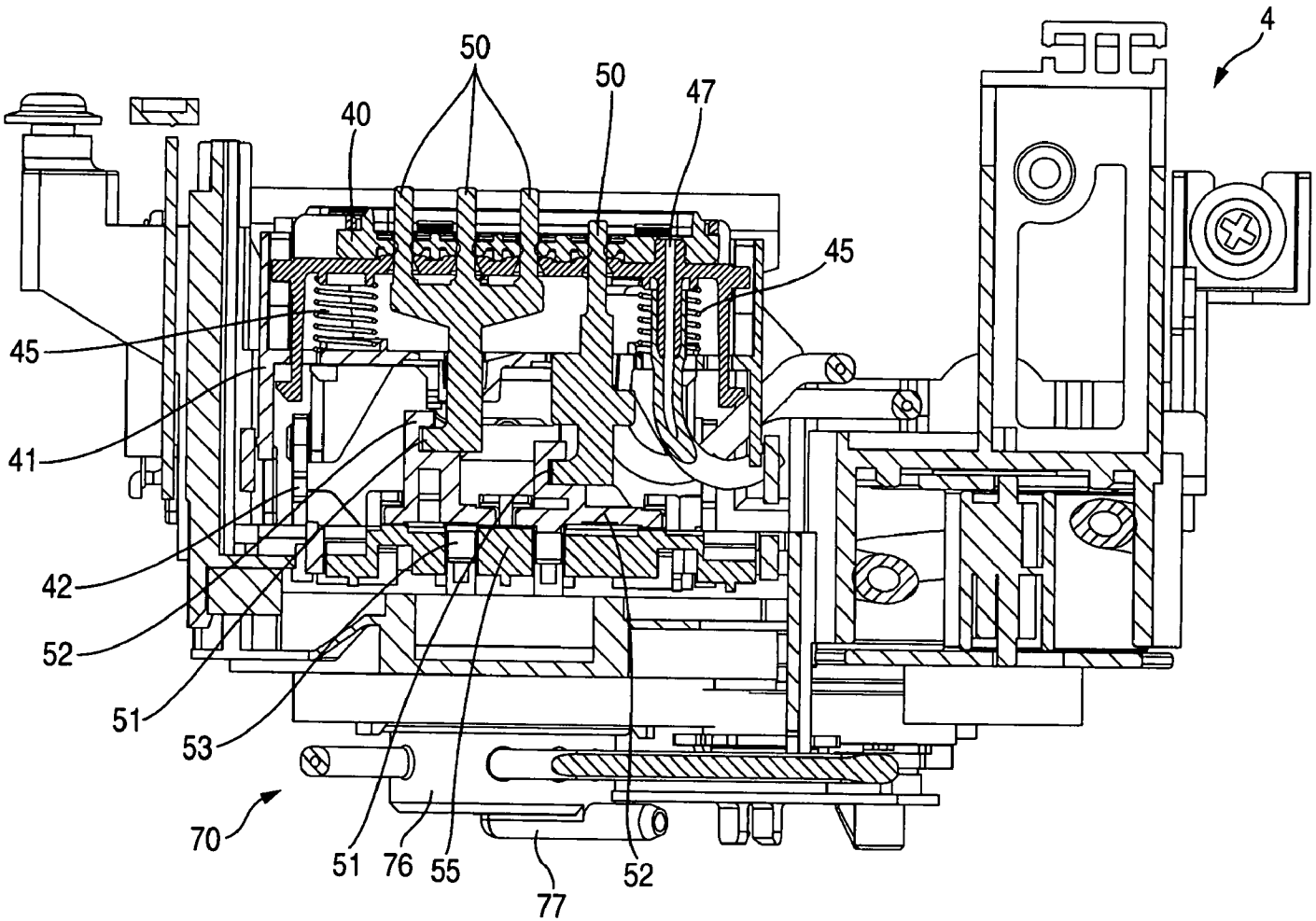
FIG. 11 is a schematic sectional view illustrating a state in which the opening and closing member for black is in a valve closing position and the opening and closing members for colors are in a valve opening position.
Figure 14:
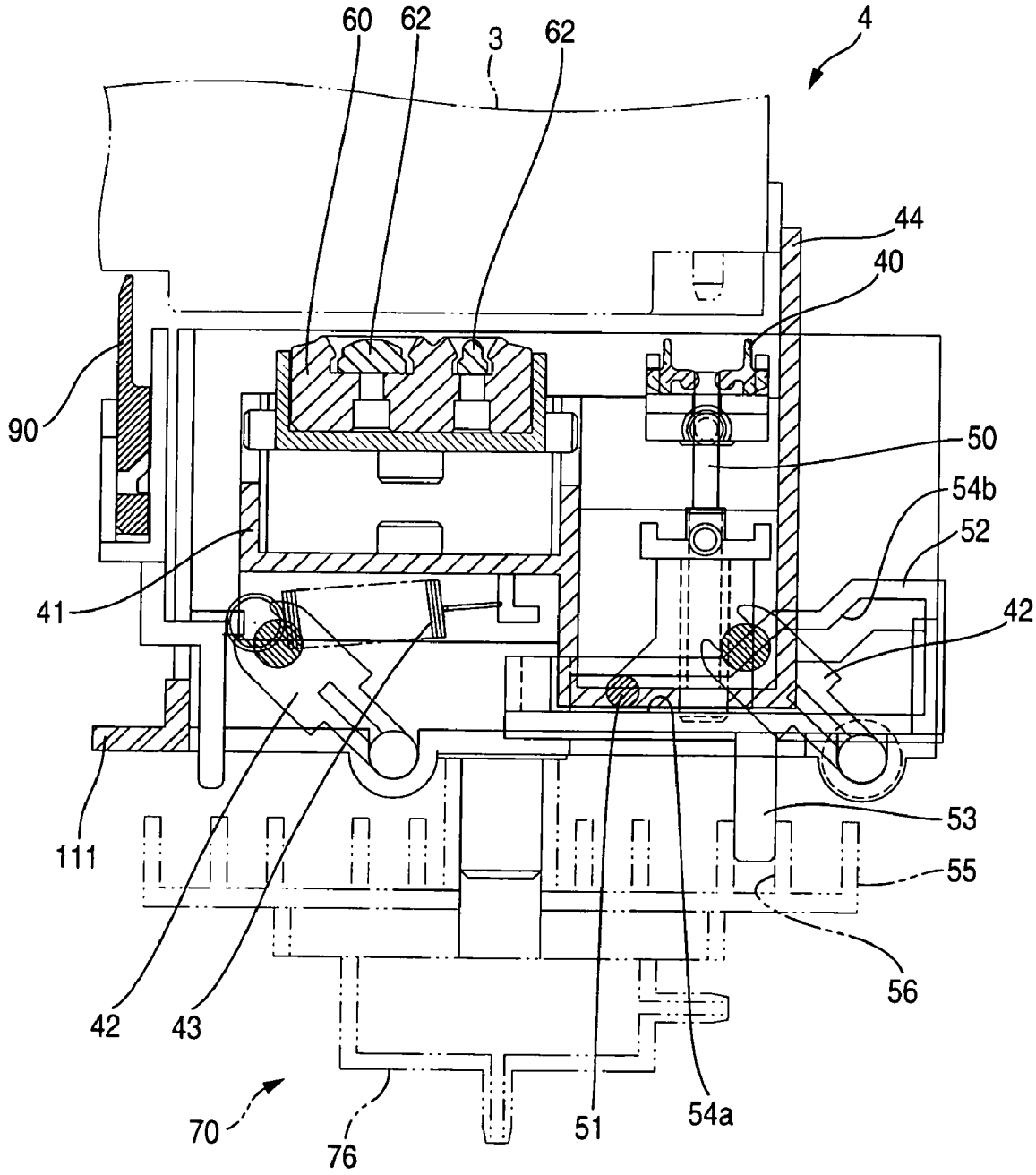
FIG. 14 is a schematic sectional view illustrating a state in which the carriage is in an idle suction position.
Figure 16:
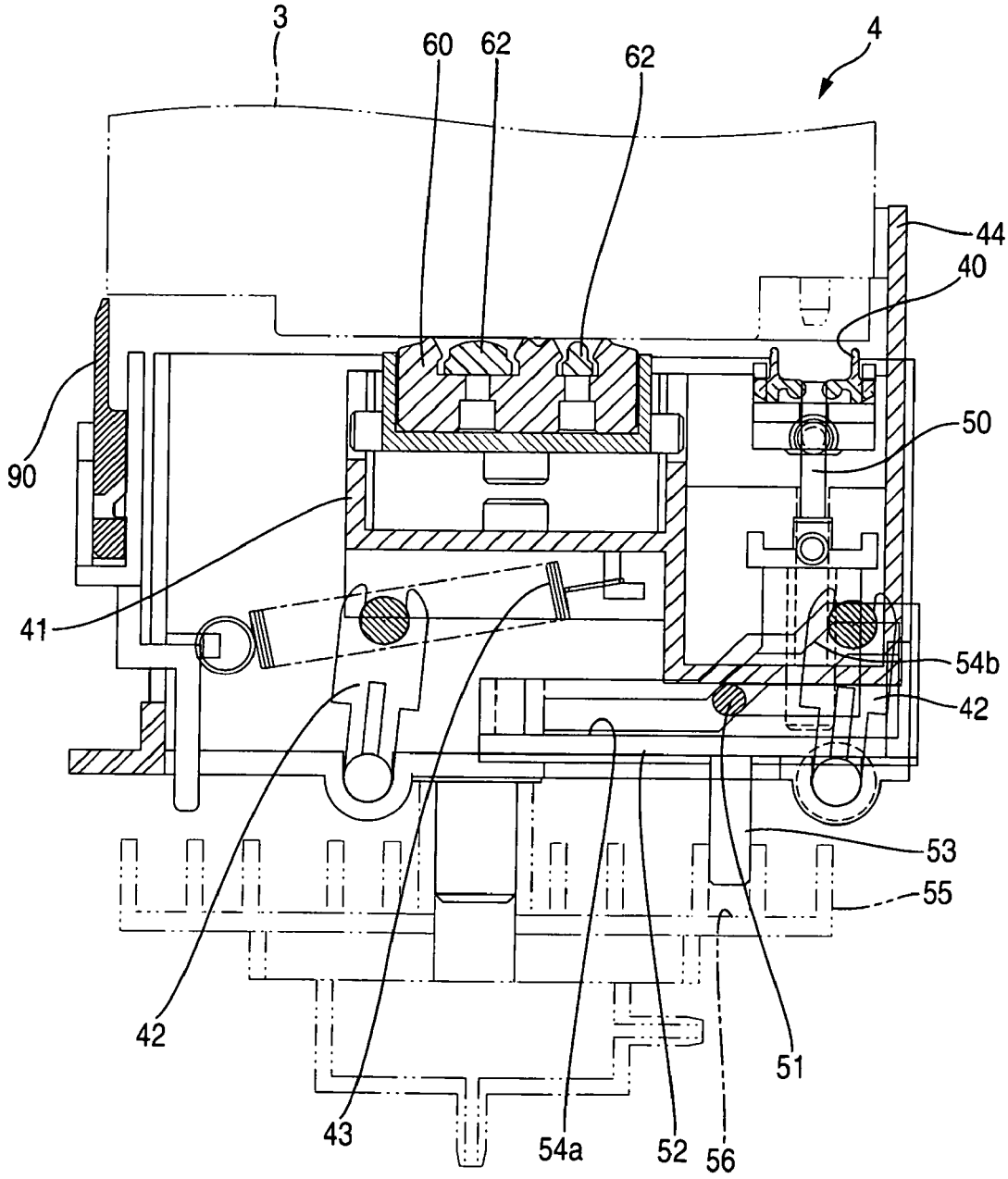
FIG. 16 is a schematic sectional view illustrating a state in which the carriage is further moved from the position shown in FIG. 15 toward the origin position and contact tightness of the nozzle cap against the carriage is increased.
Figure 17:
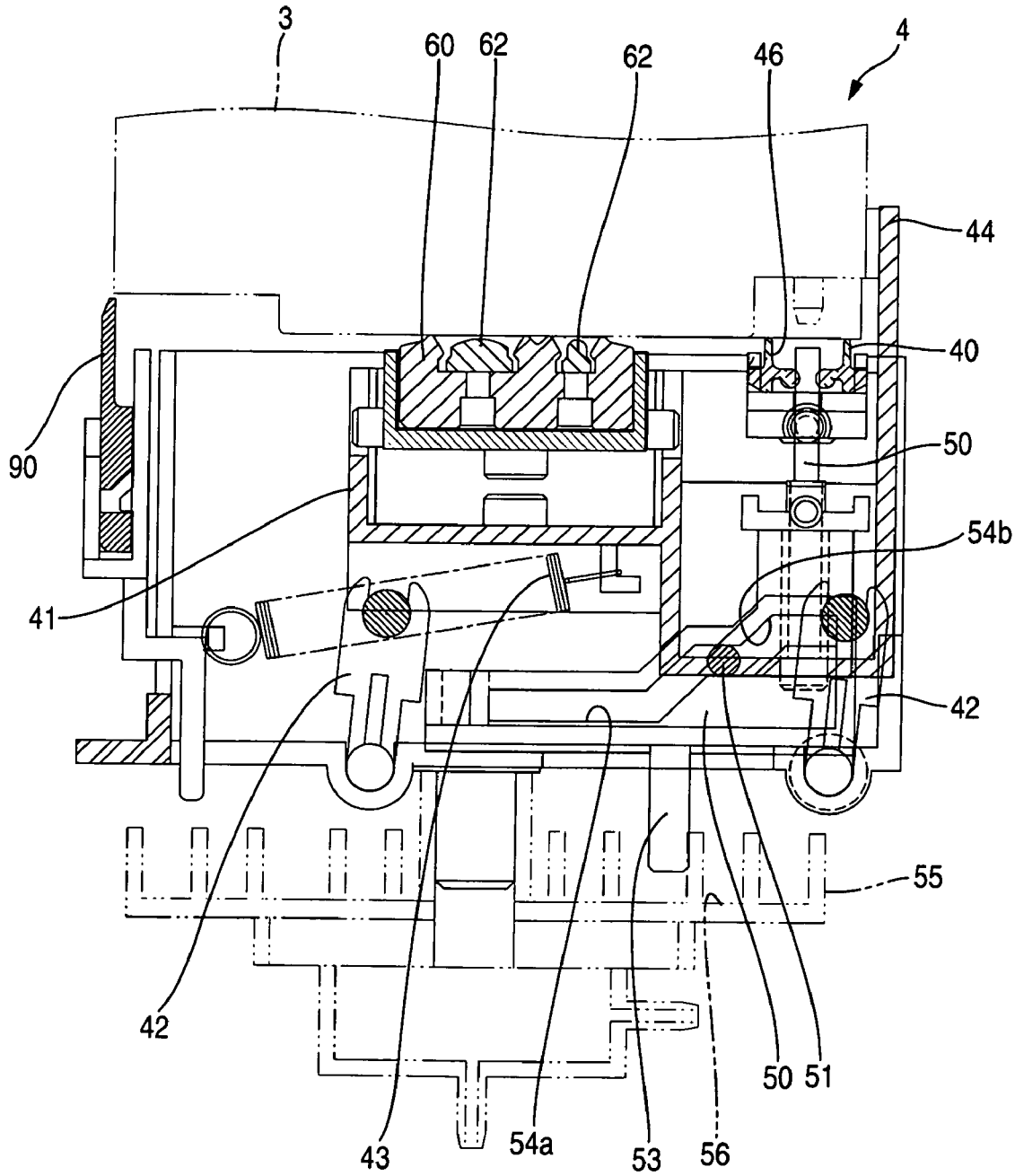
FIG. 17 is a schematic sectional view illustrating a state in which the carriage is still further moved from the idle suction position toward the origin position and a discharge cap is brought into tight contact with the carriage.
Figure 18:
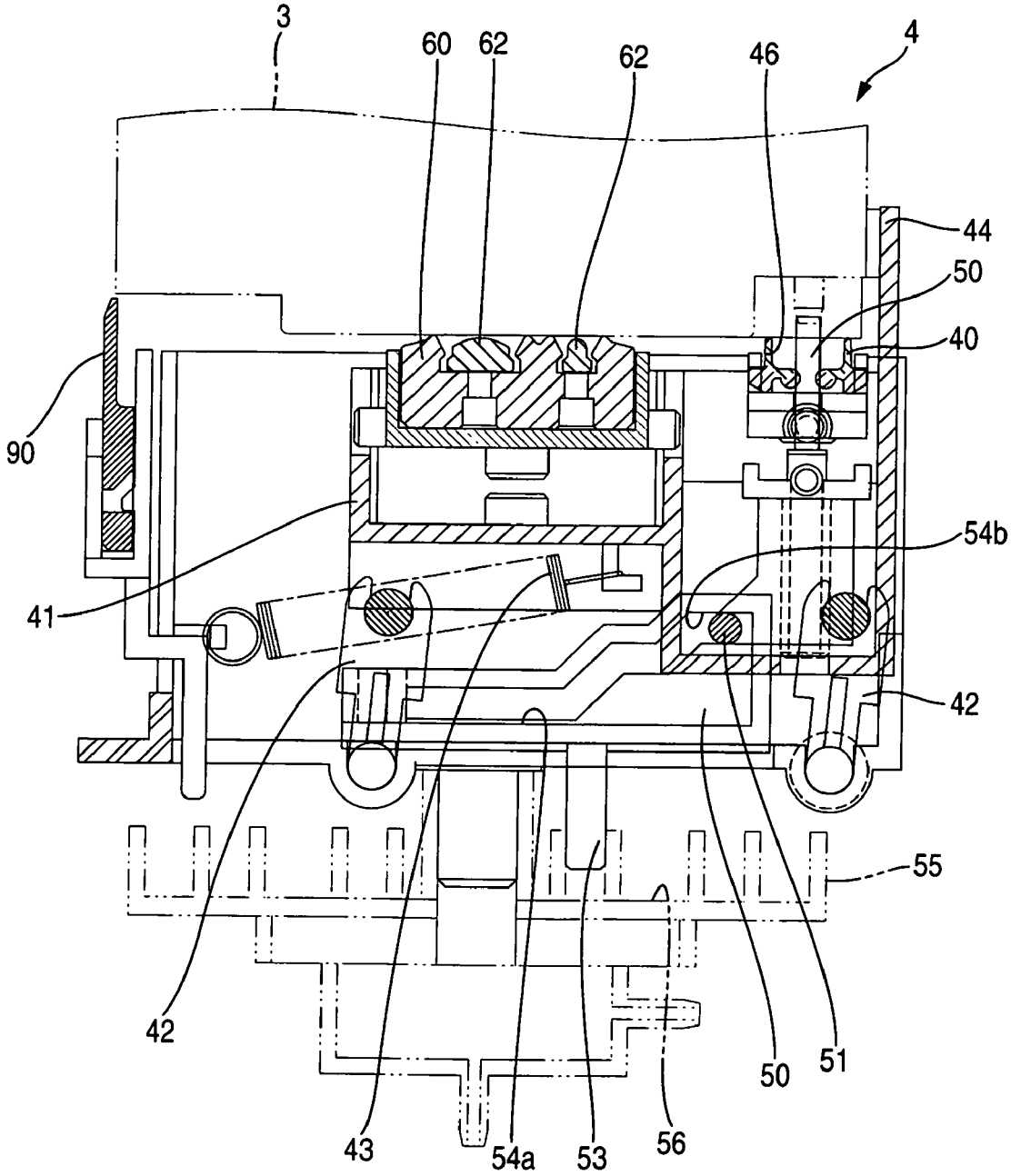
FIG. 18 is a schematic sectional view illustrating a state in which the opening and closing member is moved to the valve opening position.
Figure 19B:
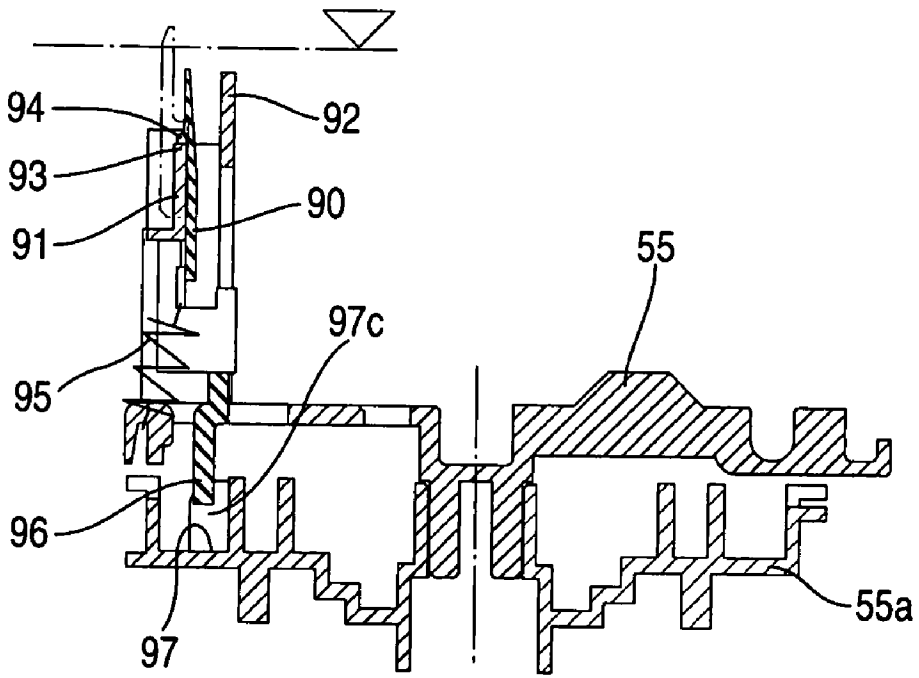
FIG. 19B is a schematic sectional view illustrating a state in which the wiper is held in the wiping position.
Figure 19A:
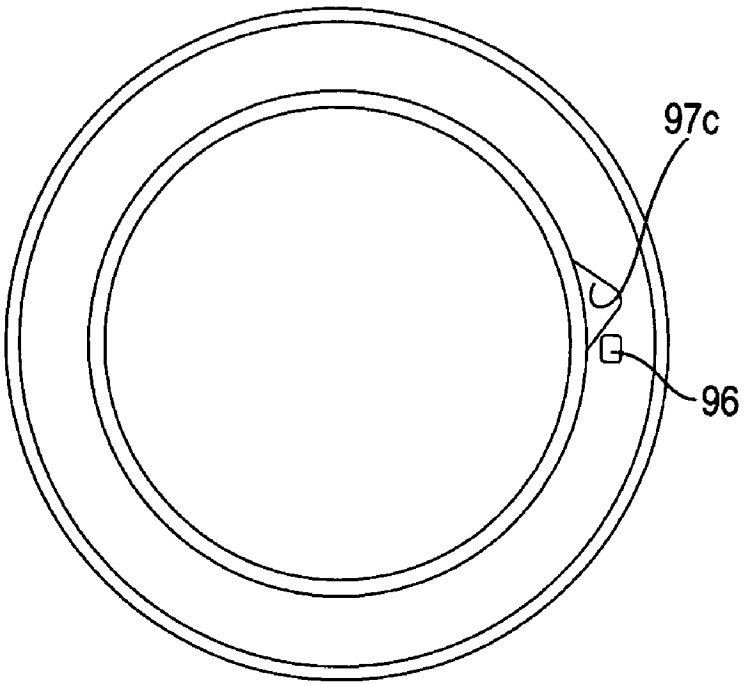
FIG. 19A is a schematic plan view illustrating a positional relationship between a cam follower of the wiper and a releasing part of the cam when the wiper is held in a wiping position.
Figure 20B:
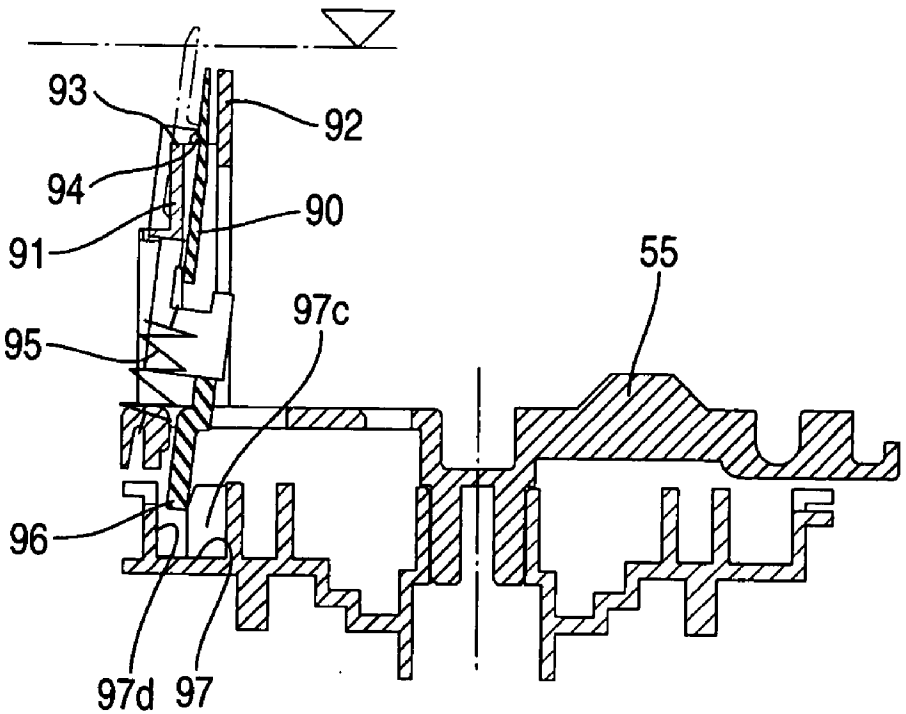
FIG. 20B is a schematic sectional view illustrating a state in which the wiper is disengaged from the engagement part in the wiping position.
Figure 20A:
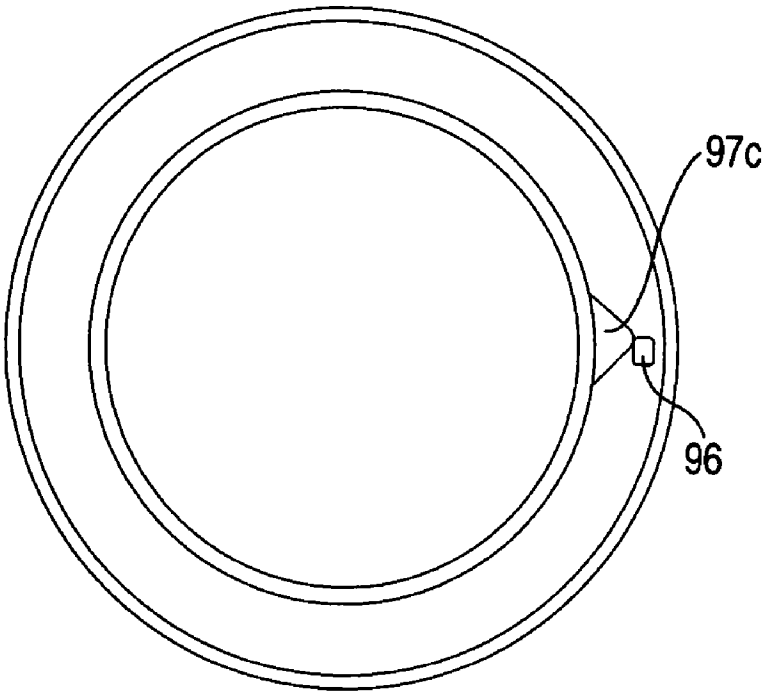
FIG. 20A is a schematic plan view illustrating a positional relationship between the cam follower of the wiper and the releasing part of the cam when the wiper is disengaged from an engagement part in the wiping position.
Figure 21A:
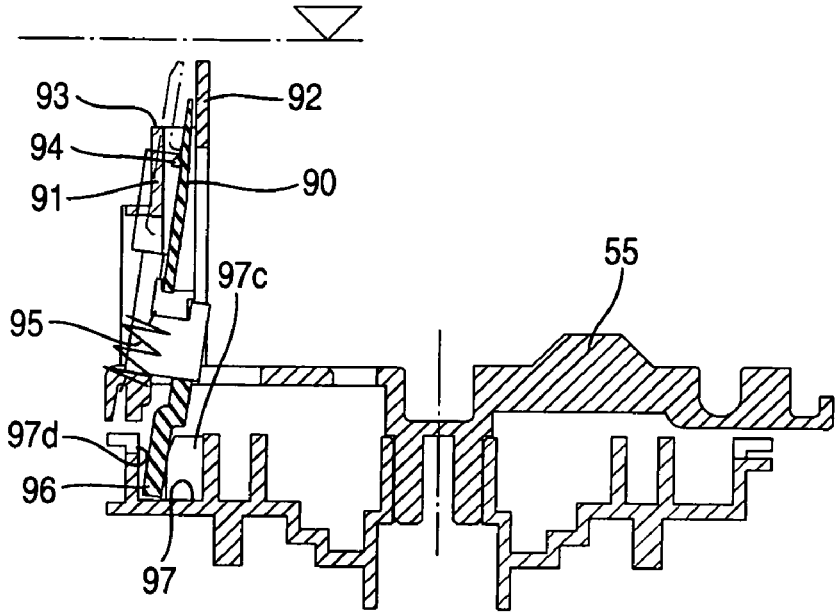
FIG. 21A is a schematic sectional view illustrating a procedure in which the wiper is in the process of being moved from the wiping position to the retracted position.
Figure 21B:
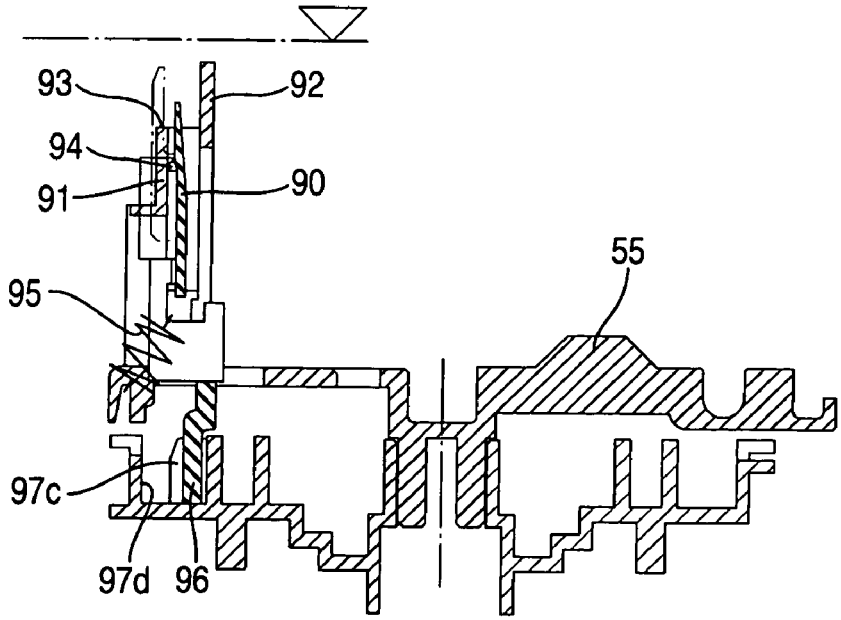
FIG. 21B is a schematic sectional view illustrating a state in which the wiper has been moved from the wiping position to the retracted position.

A cap lift holder 41 is movably provided to the maintenance frame 111. As shown in FIGS. 8, 9, and 14 through 18, the cap lift holder 41 is configured in a manner such that it can be moved parallel along an arc-shaped path in the leftward and rightward directions between a standby position and a tight contact position, by a quadric linkage mechanism which comprises left and right pairs of links 42 parallel to each other having the same length. The standby position is established as a left lower position as shown in FIGS. 8 and 14, and the tight contact position is established as a right higher position as shown in FIGS. 9 and 17. The cap lift holder 41 is biased toward the standby position by a return spring 43. A backing plate 44 is formed on the right edge of the cap lift holder 41 to extend upward. While the carriage 3 is moved from the printing region 8 toward the origin position (the maintenance position), just before the origin position, the carriage 3 is brought into contact with the backing plate 44 from the left side. Thereafter, while the carriage 3 reaches the origin position, the carriage 3 pushes the backing plate 44 to move the cap lift holder 41 against a biasing force of the return spring 43 from the standby position to the tight contact position.

At the right end position on the cap lift holder 41, a discharge cap 40 is supported by biasing springs 45 to be moved upward and downward. The discharge cap 40 is made of silicon rubber, and has a rectangular shape which is thin and extends in the forward and rearward directions. The discharge cap 40 has a depression which is opened upward. When the cap lift holder 41 is in the standby position, the discharge cap 40 is held in a standby state at a height which is lower than the lower surface of the carriage 3. If the cap lift holder 41 is pushed toward the carriage 3 and obliquely moved rightward and upward along the arc-shaped path toward the tight contact position, a lip portion which is formed on the upper edge of the discharge cap 40 is airtightly brought into contact with the lower surface of the carriage 3. Airtightness between the discharge cap 40 and the lower surface of the carriage 3 is increased by biasing forces of the biasing springs 45. By this tight contact, an airtight space 46 which is communicated with the four outlets is defined between the depression of the discharge cap 40 and the lower surface of the carriage 3 (see FIGS. 17 and 18). At the rear end of the discharge cap 40, an inlet port 47 is defined to be opened so that it can be communicated with the depression. The inlet port 47 is connected to a discharge port 78 of a switching member 70 via a tube.

<Opening and Closing Member 50 of Maintenance Unit 4>

Four rod-shaped opening and closing members 50 which are arranged in the forward and rearward directions extend upward through the lower wall of the discharge cap 40, so that they can be slid through the discharge cap 40 in an airtight manner. The opening and closing member 50 for black, which is positioned rearmost (uppermost in FIGS. 12 and 13 and rightmost in FIGS. 10 and 11) among the four opening and closing members 50, is configured to be independently moved upward and downward with respect to the discharge cap 40. A cam follower 51 which projects in a transverse direction is formed at the lower end of the opening and closing member 50 for black (see FIGS. 14 through 18). Among the four opening and closing members 50, remaining three opening and closing members 50 for colors, which are arranged forward of the opening and closing member 50 for black, are connected at the lower portions of them to be integrally moved upward and downward with one another. Another cam follower 51 which projects in the transverse direction is formed at the lower end of the combination of the three opening and closing members 50 for colors. These two cam followers 51 are respectively engaged with cam guides of two front and rear sliders 52 which are reciprocatingly moved in the leftward and rightward directions by the cam 55. The sliders 52 will be described later in detail.

The discharge cap 40 is configured to be moved integrally with the cap lift holder 41. The opening and closing members 50 are moved integrally with the discharge cap 40 in the leftward and rightward directions, but are moved relative to the discharge cap 40 in the upward and downward directions. Due to the fact that relative movement of the opening and closing members 50 in the upward and downward directions is allowed in this way, the opening and closing members 50 are always held engaged with the sliders 52 irrespective of a position of the cap lift holder 41.

<Driving Mechanism for Opening and Closing Members 50>

Figure 12:
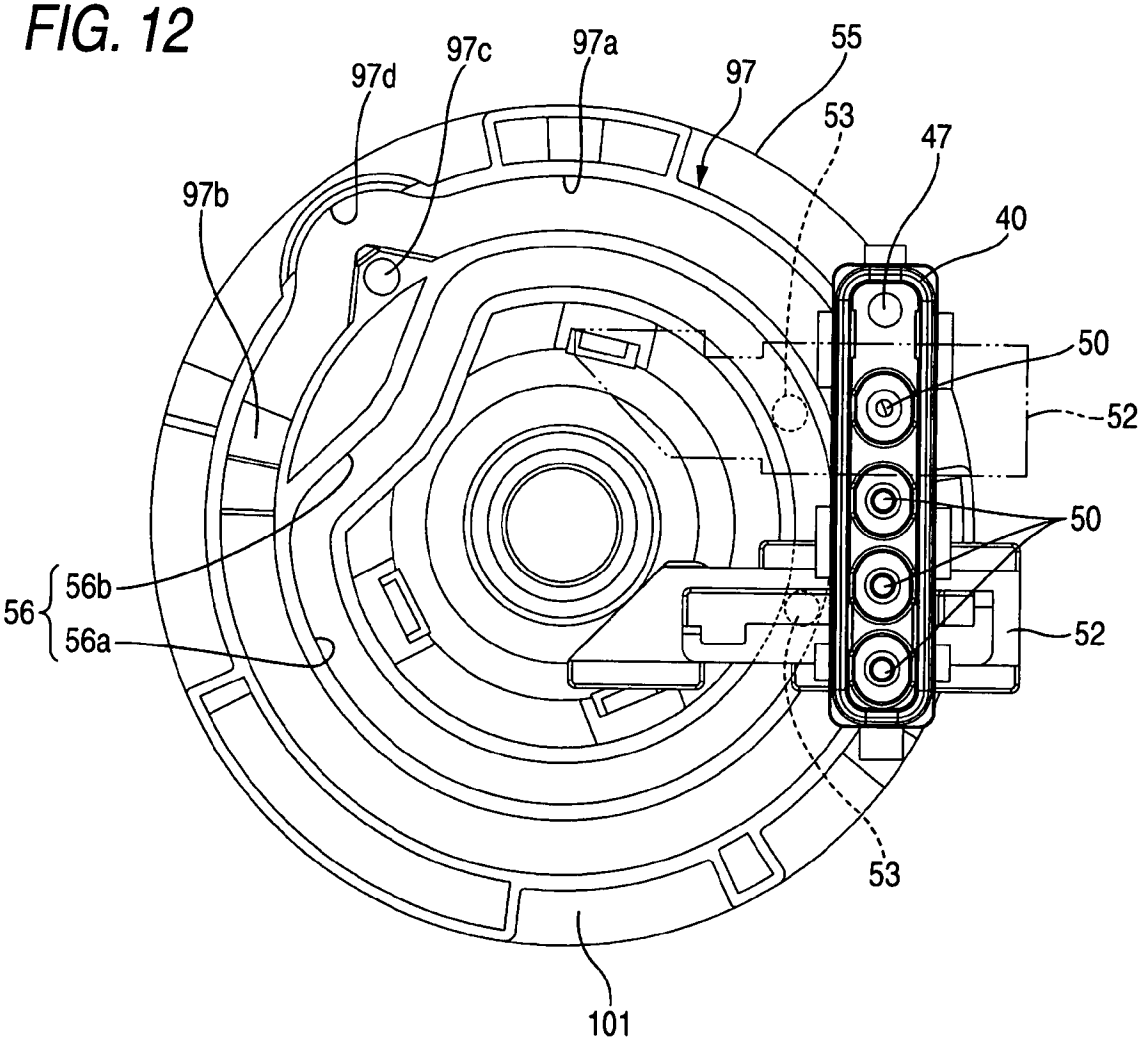
FIG. 12 is a plan view of a cam, illustrating a state in which the opening and closing members for colors are in the valve closing position.
Figure 13:
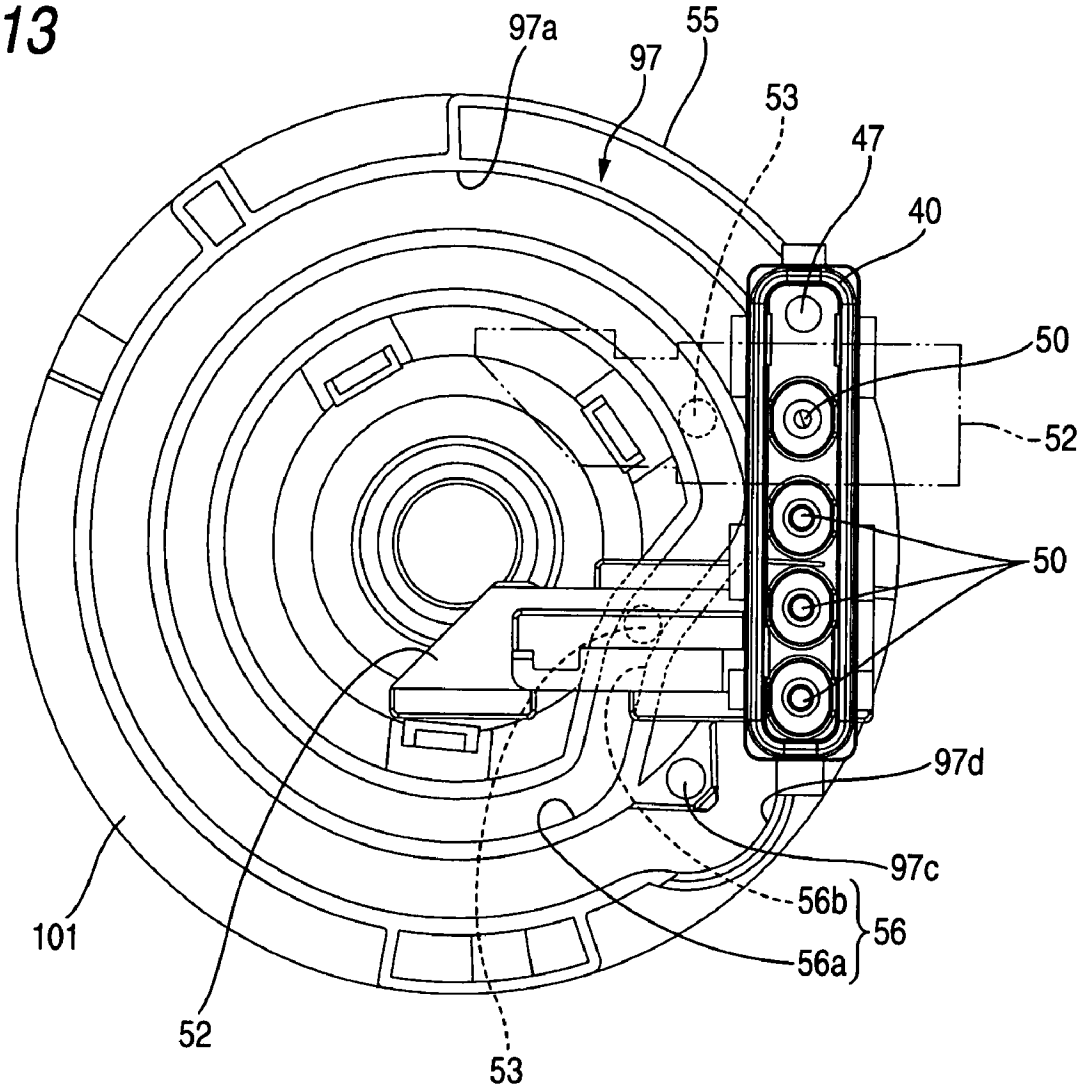
FIG. 13 is a plan view of the cam, illustrating a state in which the opening and closing members for colors are in the valve opening position.

A cam groove 56 is defined on the upper surface of the cam 55. As shown in FIGS. 12 and 13, the. cam groove 56 comprises a non-driving zone 56*a* which has a contour of an arc concentric to the cam 55, and a driving zone 56*b* which is connected to the non-driving zone 56*a* and has a contour curved from the non-driving zone 56*a* toward the center of the cam 55. The two front and rear sliders 52 are supported by the maintenance frame 111 in a manner such that they can be independently moved above the cam 55 in the leftward and rightward directions (which are parallel to the moving directions of the carriage 3). Cam followers 53 which project downward from the respective sliders 52 are engaged in the cam groove 56 at a rightward position of the center of the cam 55. If the cam followers 53 are engaged in the non-driving zone 56*a* of the cam groove 56, the sliders 52 are held in a standby state at a right position (see FIG. 12), and if the cam follower 53 is engaged in the driving zone 56*b* of the cam groove 56, the corresponding slider 52 is slid leftward (see FIG. 13). The rear (upper in FIG. 12) slider 52 is to drive the opening and closing member 50 for black ink, and the front slider 52 is to drive the opening and closing members 50 for color ink.

Each slider 52 is formed with a free guide 54*a* and a cam guide 54*b* for engaging the cam follower 51 of the opening and closing member 50. As can be readily seen from FIGS. 14 through 18, the free guide 54*a* extends in the leftward and rightward directions (that is, parallel to the moving direction of the slider 52) to define a straight path and then upward adjacent to a right end thereof to define an inclined path. The cam guide 54*b* is connected to the right end of the free guide 54*a* and has an inclined portion which has an upward slope in the rightward direction.

In a state in which the cap lift holder 41 is in the standby position, even when the slider 52 is engaged in any one of the non-driving zone 56*a* and the driving zone 56*b* of the cam 55, the cam follower 51 of the opening and closing members 50 is always engaged in the free guide 54*a* and is never engaged in the cam guide 54*b*. If the cap lift holder 41 is moved to the tight contact position by the carriage 3, the cam follower 51 of the opening and closing members 50 which are moved integrally with the cap lift holder 41 in the rightward direction is engaged from the free guide 54*a* into the cam guide 54*b*. At this time, the cam follower 53 of the slider 52 is engaged in the non-driving zone 56*a*, the cam follower 51 of the opening and closing members 50 is engaged in the left end portion of the cam guide 54*b* which is lowermost (at the same height as the right end of the free guide 54*a*), and the opening and closing members 50 are held in a valve closing position which corresponds to the lowermost position. In this valve closing position, since the upper ends of the opening and closing members 50 are positioned lower than the lower ends of the valve bodies 20 of the opening and closing valves 19, the opening and closing valves 19 are held closed.

From this state, if the cam follower 53 of the slider 52 is slid leftward to be engaged in the driving zone 56*b*, because the cam follower 51 of the opening and closing members 50 is moved rightward along the cam guide 54*b* to climb the inclined portion, the opening and closing members 50 are moved upward from the valve closing position to a valve opening position. If the opening and closing members 50 are moved to the valve opening position, because the upper ends of the opening and closing members 50 are brought into contact with the lower ends of the valve bodies 20 to push upward the valve bodies 20, the opening and closing valves 19 are held opened. That is to say, the opening and closing members 50 are moved from the valve closing position to the valve opening position while being inserted into the discharge paths 17 of the carriage 3 in a direction which is substantially perpendicular to the moving direction of the carriage 3, to open the opening and closing valves 19.

<Nozzle Cap 60 of Maintenance Unit 4>

In the cap lift holder 41, at the left side of the discharge cap 40, a nozzle cap 60 is supported by a biasing spring 61 so that it can be relatively moved in the upward and downward directions. The nozzle cap 60 is made of silicon rubber, and has a rectangular shape which extends in the forward and rearward directions. The nozzle cap 60 has left and right depressions which are opened upward and in which spacers 62 having a semicircular sectional shape are respectively accommodated. In a state in which the cap lift holder 41 is in the standby position, the nozzle cap 60 is held in a standby state at a height which is lower than the lower surface of the carriage 3. If the cap lift holder 41 is pushed toward the carriage 3 and obliquely moved rightward and upward along the arc-shaped path toward the tight contact position, a lip portion which is formed on the upper edge of the nozzle cap 60 is airtightly brought into contact with the lower surface of the carriage 3. Airtightness between the nozzle cap 60 and the lower surface of the carriage 3 is increased by a biasing force of the biasing spring 61. By this tight contact, two independent left and right closed spaces 63 which are communicated with the nozzles of the printing heads 10 are defined between the upper surfaces of the spacers 62 of the nozzle cap 60 and the lower surface of the carriage 3 (see FIG. 16). The right narrow closed space 63 for black ink is associated with the nozzles for black, and the left wide closed space 63 for color ink is associated with the nozzles for the three colors.

An inlet 64 is defined to be opened through the bottom wall of each depression of the nozzle cap 60 to be positioned at the rear end (one lengthwise end) of the bottom wall. The inlet 64 of the narrow depression for black ink is connected by way of a tube to a port 79 for black ink (hereinafter, referred to as a "Bk port"), of the switching member 70, and the inlet 64 of the wide depression for colors is connected by way of a tube to a port 80 for color ink (hereinafter, referred to as a "Co port"), of the switching member 70. Each closed space 63 has a vertical size which is smallest at a leftward and rightward (that is, widthwise) middle portion of the closed space 63 and is gradually increased toward both left and right ends of the closed space 63. Therefore, when sucking ink from the nozzles through the inlet ports 64 by inducing a negative pressure in the closed space 63, air flow (containing ink) is substantially uniformly created over the entire length of the closed space 63 to be directed from the widthwise middle portion of the closed space 63 to the left and right ends (having a low flow resistance) of the closed space 63. The air flow is joined at the left and right ends of the closed space 63 to form voluminous air flow which is directed to and then introduced into the inlet port 64 (defined at the rear end of the closed space 63). As a consequence, although the inlet port 64 is defined in the rear end of the closed space 63 which extends in the forward and rearward directions, air flow is made uniform over the entire area of the closed space 63, whereby ink purging operation can be uniformly implemented for the entire nozzles.

<Switching Member 70 of Maintenance Unit 4>

The switching member 70 performs a function of switching the airtight space 46 defined by the discharge cap 40 between a state in which the airtight space 46 is communicated with the pump 38 and a state in which the airtight space 46 is shut off from the pump 38, and a function of switching the closed space 63 defined by the nozzle cap 60 between a state in which the closed space 63 is communicated with the pump 38 and a state in which the closed space 63 is shut off from the pump 38. The switching member 70 comprises a mounting part 71 which is formed on the lower surface of the cam 55, a switching member 73, and a cover 76.

As shown in FIG. 5, the mounting part 71 defines a circle which is concentric to the cam 55 and the driven gear 36. Position determining projections 72 are formed on a circumferential outer surface of the mounting part 71. The switching member 73 is made of rubber and has a shape of a disc. Switching paths 74 are defined on the outer surface of the switching member 73. The switching paths 74 comprise four branched grooves 74*a* which extend radially from the center of the lower surface of the switching member 73, and communicated grooves 74*b* which are defined to be communicated with the outer ends of the branched grooves 74*a*. The switching member 73 has a position determining projections 72 fitted into a position determining groove 75 which is defined on the upper surface of the switching member 73, and is also fitted into the mounting part 71 (see FIGS. 8 and 9). By this fact, the switching member 73 can be rotated concentrically to and integrally with the cam 55 and the driven gear 36.

The cover 76 is made of synthetic resin, and has a shape of a bottomed cylinder. An inlet port 77 is formed at the center of the bottom wall of the cover 76 to be connected to the pump 38 via a tube. The cylindrical side wall of the cover 76 is formed with five ports 78 through 82 which are spaced apart one from another by a predetermined angle. The first port is the discharge port 78 which is communicated with the airtight space 46 defined by the discharge cap 40, the second port is the Bk port 79 (the port for black ink) which is communicated with one closed space 63 for black defined by the nozzle cap 60, the third port is the Co port 80 (the port for color ink) which is communicated with the other closed space 63 for color defined by the nozzle cap 60, and the remaining two ports are atmospheric ports 81 and 82 which are opened to the atmosphere.

The cover 76 constructed in this way is mounted to the cam 55 by engagement 3 clips 83 which are formed on the lower surface of the cam 55. Concretely speaking, a flange 84 is continuously formed on the outer circumference of the cover 76 to extend in a totally circumferential direction. The three engagement clips 83 are located on a circle which is concentric to the cam 55 such that they are spaced apart one from another by a preselected angle and can be elastically bent in a radial direction. When the cover 76 is mounted to the lower surface of the cam 55, the three engagement clips 83 are engaged with the lower surface of the flange 84 from the outer circumference of the flange 84. By this fact, the cover 76 is supported in a manner such that it can be rotated relative to the cam 55 and the switching member 73 and cannot be moved in the upward and downward directions (an axial direction of the cam 55). With the cover 76 mounted to the cam 55, the switching member 73 is received in the cover 76, a lip portion which is formed on the outer circumferential surface of the switching member 73 is brought into contact with the inner circumferential surface of the cover 76. When the cover 76 and the switching member 76 are rotated relative to each other, a sliding resistance (frictional resistance) is generated between the lip portion of the switching member 73 and the inner circumferential surface of the cover 76.

An arm 85 which extends in a radial direction is formed integrally on the outer circumferential surface of the cover 76. The distal end of the arm 85 is rotatably fitted around the shaft 33 of the sun gear 32. Due to this fitting of the arm 85 around the shaft 33, the cover 76 is held with respect to the maintenance frame 111 so that the cover 76 cannot be directly rotated, and positions of the ports 78 through 82 of the cover 76 are fixed. The arm 85 is prevented from being released downward, by a release prevention projection 33*a* of the shaft 33. The pivot arm 34 is fitted around the shaft 33 between the arm 85 and the sun gear 32 which is positioned above the arm 85, so that the pivot arm 34 can be rotated relative to the shaft 33.

When the switching member 73 is rotated in the cover 76, the switching member 73 is held in a state in which all of the four communicated grooves 74*b* of the switching member 73 are not communicated with any one of the ports 78 through 82, and a state in which one or three communicated grooves 74*b* among the four communicated grooves 74*b* are communicated with the ports 78 through 82. In the state in which all communicated grooves 74*b* are not communicated with any one of the ports 78 through 82, all ports 78 through 82 are shut off from the pump 38. In the state in which one or three communicated grooves 74*b* are communicated with the ports 78 through 82, the port 78 through 82 which is communicated with the communicated groove 74*b* is communicated with the pump 38 via the switching path 74, or the ports 78 through 82 which are communicated with the communicated grooves 74*b* are communicated with one another via the switching path 74 and with the pump 38. Concrete switching modes will be described later in detail.

<Wiper 90 of Maintenance Unit 4>

Another cam groove is defined on the upper surface of the cam groove. This cam groove is substantially concentrically located outward of the aforementioned cam groove for the opening and closing members 50. The cam groove comprises an arc-shaped part which is concentric to the cam 55, a protruded part which has the same diameter as the arc-shaped part and formed on a portion of the arc-shaped part to extend in a circumferential direction, a releasing part which has the same diameter as the arc-shaped part and extends in the circumferential direction, and a relief part which is located radially outward of the releasing part and faces the releasing part.

The wiper 90 functions to wipe ink attached to surfaces of the nozzles of the printing heads 10. The wiper 90 is arranged on the maintenance frame 111 in a manner such that it is positioned leftward of the cap lift holder 41, that is, between the origin position (the maintenance position) and the printing region 8 in the moving path of the carriage 3. When viewed in its entirety, the wiper 90 has a shape of a plate which is substantially perpendicular to the moving direction of the carriage 3. Above the cam 55, the wiper 90 is moved between a retracted position (see FIG. 21) which is below the moving path of the carriage 3 and a wiping position (see FIGS. 19A and 19B) which projects to the moving path of the carriage 3.

The wiper 90 is placed between a restriction plate 91 which is positioned at a left side and a plate-shaped stopper 92 which is positioned at a right side, with a predetermined clearance. By this fact, the wiper 90 is not moved in the leftward and rightward directions in a substantial degree and instead guided to be moved upward and downward. The restriction plate 91 which is positioned at the left side is formed with an engagement part 93, and an engagement projection 94 is formed on the left surface of the wiper 90. Due to the fact that the engagement projection 94 is engaged with the engagement part 93 from the top, the wiper 90 can be held in the wiping position. Also, in the wiper 90, between a position which is located at a left side of the restriction plate 91 and the maintenance frame 111, there is arranged a spring 95 for obliquely biasing the wiper 90 in a left downward direction. The wiper 90 is formed with a cam follower 96 which projects downward. This cam follower 96 is engaged in a cam groove 97 at a position which is leftward of the center of the cam 55.

The cam groove 97 comprises the arc-shaped part 97*a* which is concentric to the cam 55 and is capable of holding the wiper 90 in the retracted position, the protruded part 97*b* which is located on a circumferential portion having the substantially same diameter as the arc-shaped part 97*a* and interferes with the wiper 90 held in the retracted position to push and move the wiper 90 to the wiping position, and the releasing part 97*c* which is located on a circumferential portion having the same diameter as the arc-shaped part 97*a* and radially interferes with the cam follower 96 of the wiper 90 held in the wiping position.

In a state in which the cam follower 96 is engaged in the arc-shaped part 97*a*, the cam follower 96 is brought into contact with the upper surface of the arc-shaped part 97*a* by the biasing force of the spring 95. At this time, the wiper 90 is held in the retracted position. As the protruded part 97*b* approaches the cam follower 96, the cam follower 96 rides on the protruded part 97*b*, whereby the wiper 90 is raised to the wiping position. During this period, since the wiper 90 is squeezed against the restriction plate 91 with the spring 95 obliquely tensed leftward, at the time the wiper 90 reaches the wiping position, the engagement projection 94 is engaged with the engagement part 93, whereby the wiper 90 is held in the wiping position.

When the wiper 90 is in the wiping position, a wiping portion which is formed at the upper end of the wiper 90 projects upward beyond the restriction plate 91. In the wiping position, the wiper 90 is brought into contact with the right surface of the restriction plate 91, and the cam follower 96 is brought into contact with the circumferential surface of the arc-shaped part 97*a* from the right side. In this state, the wiper 90 is obliquely pulled to extend in the left downward direction by the spring 95. Thus, even when the carriage 3 interferes with the upper end of the wiper 90 from the right side (that is, while moving from the origin position (the maintenance position) toward the printing region 8), the wiper 90 is squeezed against the restriction plate 91, and the engagement projection 94 is held engaged with the engagement part 93. At this time, as the wiper 90 rubs the nozzle surfaces of the printing heads 10, ink attached to the nozzle surfaces is removed.

If the carriage 3 interferes with the upper end of the wiper 90 from the left side, as the wiper 90 is changed in its posture to be inclined toward the right side, the engagement projection 94 is disengaged from the engagement part 93, and under the biasing action of the spring 95, the wiper 90 is lowered from the wiping position to the retracted position.

The wiper 90 held in the wiping position can be lowered to the retracted position also by the releasing part 97*c* of the cam 55. Concretely speaking, if the tapered surface of the releasing part 97*c* is brought into contact with the lower end of the cam follower 96 by the rotation of the cam 55, due to the inclination of the tapered surface, the lower end of the cam follower 96 is pressed leftward to be moved into the relief part 97*d*. In other words, the releasing part 97*c* interferes with the wiper 90 in a radial direction. Following this, the wiper 90 is changed in its posture to be inclined rightward about the lower edge of the restriction plate 91, and thereby, the engagement projection 94 is disengaged from the engagement part 93. Then, by the biasing force of the spring 95, the wiper 90 is pulled downward to be lowered to the retracted position.

<Carriage Lock 100 of Maintenance Unit 4>

A circular flange part 101 of which lower surface serves as a cam surface 102 is formed at an outer circumference of the cam 55. An upwardly concaved portion is partially formed on the cam surface 102 to serve as a locking zone 102*a* (see FIG. 5). The cam surface 102 also has an unlocking zone 102*b* which extends lower than the locking zone 102*a*. A carriage lock 100 is supported in a manner such that it can be moved upward and downward with respect to the maintenance frame 111 and it is biased upward by an un-illustrated spring. A cam follower 103 which is formed at the lower end of the carriage lock 100 is brought into contact with the cam surface 102 from the bottom. Consequently, most of the carriage lock 100 is positioned upward of the cam 55. In a state in which the cam follower 103 is brought into contact with the unlocking zone 102*b*, the carriage lock 100 is held in a lower unlocking position, and in a state in which the cam follower 103 is brought into contact with the locking zone 102*a*, the carriage lock 100 is moved upward to the moving path of the carriage 3. At this time, if the carriage 3 is positioned in the origin position (the maintenance position), the upper end of the carriage lock 100 is engaged with a front end portion of the left surface of the carriage 3. By this engagement, the carriage 3 is prevented from being moved leftward toward the printing region 8.

<Member for Controlling Rotational Position of Cam 55>

A detected part 105 is arranged on a flange portion 101 which is formed on the outer circumference of the cam 55, to be rotated integrally with the cam 55. A leaf switch 106 is provided to the maintenance frame 111 so that the leaf switch 106 is turned on and off by the detected part 105 as the cam 55 is rotated. If the leaf switch 106 is in a turned-on state or turned-off state (that is, positions A(M), N, O, P, Q, R, S and K in FIG. 22), an rpm of the motor 24 for driving the cam 55 is counted, and thereby, a stop position of the cam 55 can be precisely controlled. In the description given below with respect to procedures such as a maintenance procedure, explanation regarding operation for tuning on and off the leaf switch 106 and thereby controlling a rotated position of the cam 55 will be omitted.

<Operation of Cap Lift Holder 41 Following the Movement of Carriage 3>

In a state in which the cap lift holder 41 is held in the retracted position by the biasing force of the return spring 43, if the carriage 3 is moved from the printing region 8 toward the origin position, as shown in FIG. 14, at the time the carriage 3 reaches the idle suction position, the carriage 3 is brought into contact with the backing plate 44 of the cap lift holder 41. At this time, both of the discharge cap 40 and the nozzle cap 60 are positioned lower than the lower surface of the carriage 3. Namely, both of the discharge cap 40 and the nozzle cap 60 are not brought into contact with the lower surface of the carriage 3.

Figure 15:
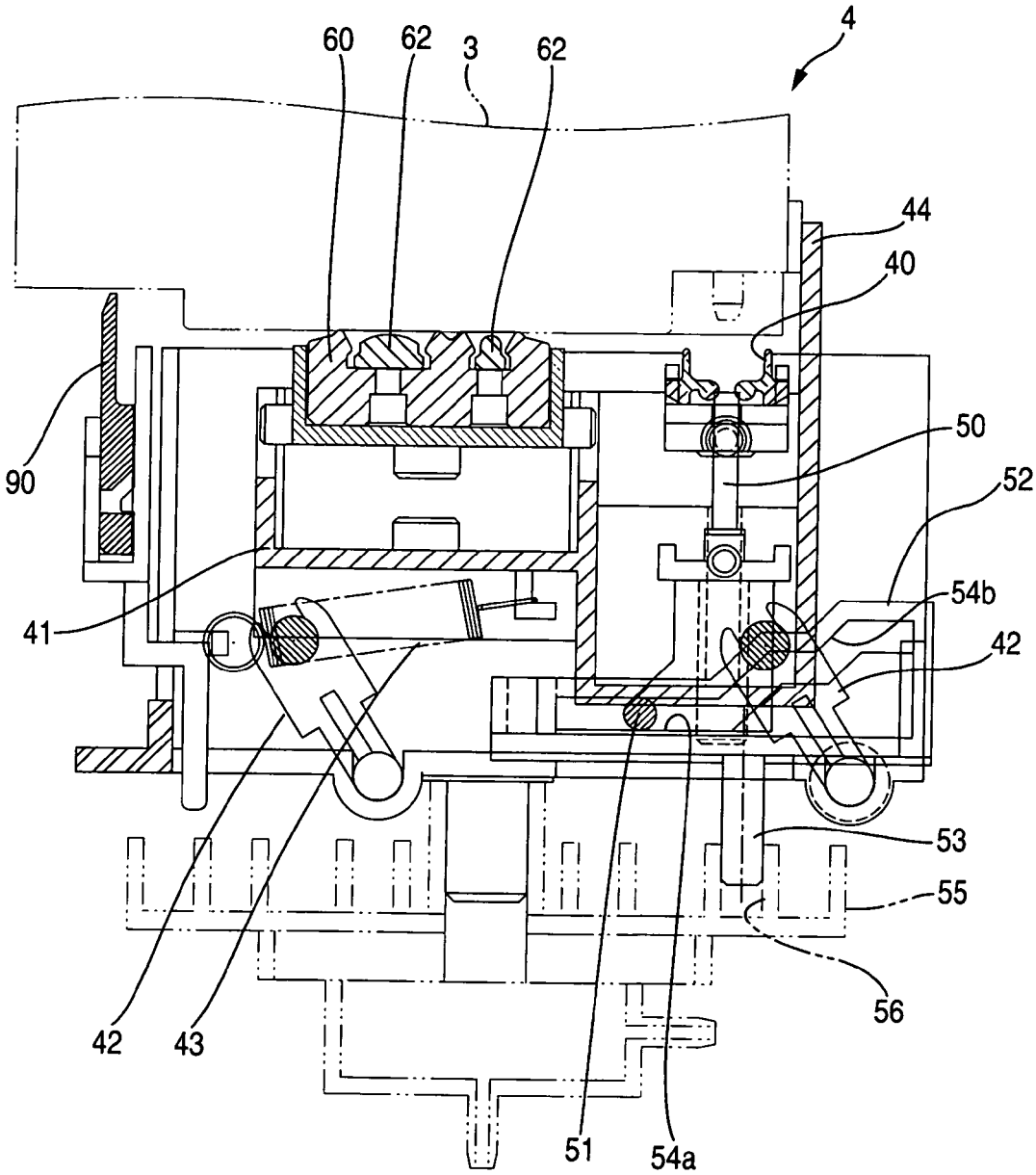
FIG. 15 is a schematic sectional view illustrating a state in which the carriage is moved from the idle suction position toward the origin position and a nozzle cap is brought into tight contact with the carriage.

In this state, if the carriage 3 is further moved toward the origin position, as shown in FIG. 15, the cap lift holder 41 is obliquely moved along the arc-shaped path in the right upward direction, and the nozzle cap 60 is brought into contact with the nozzle surfaces of the printing heads 10 in its lower position. In succession, if the carriage 3 is further moved rightward, as shown in FIG. 16, the spring 61 arranged between the cap lift holder 41 which moves upward and the nozzle cap 60 which is brought into contact with the lower surface of the carriage 3 is elastically compressed, and by the elastic returning force of the spring 61, the nozzle cap 60 is forcefully squeezed against the printing heads 10, whereby the closed spaces 63 which are reliably sealed in an airtight manner is defined between the nozzle surfaces and the nozzle cap 60.

In this state, if the carriage 3 is further moved rightward and reaches the origin position, as shown in FIG. 17, the discharge cap 40 is brought into tight contact with the lower surface of the carriage 3, and the discharge cap 40 is squeezed against the lower surface of the carriage 3 by the elastic force of the biasing springs 45 which are arranged between the discharge cap 40 and the cap lift holder 41, whereby the airtight space 46 which is reliably sealed in an airtight manner is defined between the lower surface of the carriage 3 and the discharge cap 40.

<Discharge Process and Idle Suction Process in Maintenance Position>

In an initial stage of a procedure for discharging the bubbles collected in the bubble collecting chambers 12, the carriage 3 is held in the origin position and engaged by the carriage lock 100 to be locked to the origin position. Also, in a state in which the carriage 3 is locked to the origin position, the discharge cap 40 is brought into tight contact with the lower surface of the carriage 3 to define the airtight space 46. Further, the cam 55 and the switching member 73 are held at the position A(M) of FIG. 22, and are not communicated with any one of the atmosphere and the pump 38. Both of the closed space 63 for black and the closed space 63 for colors are opened to the atmosphere by way of the switching paths 74 of the switching member 73 and at the same time, communicated with the pump 38.

Figure 22:
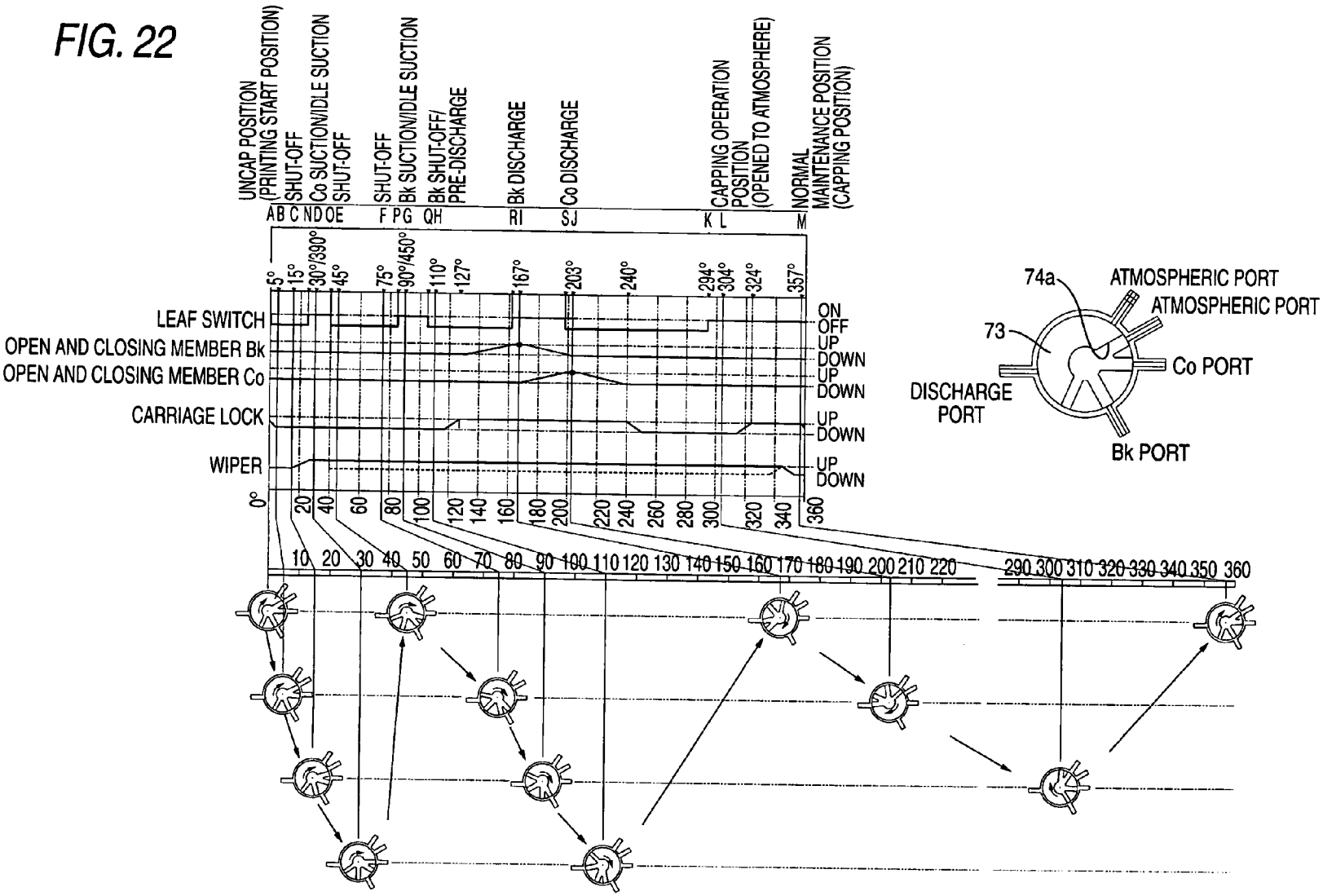
FIG. 22 is a chart illustrating positions of the cam and a switching member, a moved state of the opening and closing members, a moved state of a carriage lock, and a moved state of the wiper.

In this state, as the cam 55 and the switching member 73 are rotated to the position H of FIG. 22 and then stopped, the airtight space 46 is communicated only with the pump 38 by way of the switching member 73. At this time, both of the closed space 63 for black and the closed space 63 for colors are not communicated with the atmosphere and the pump 38 and held in the shut-off state. In this state, the planetary gear 35 revolves around the sun gear 32 to drive the pump 38 and air existing in the airtight space 46 is discharged, whereby a negative pressure is induced in the airtight space 46.

After pre-discharging operation is implemented in this way, the cam 55 and the switching member 73 are moved to the position I. During this movement, the slider 52 for black is moved leftward due to engagement with the cam 55, and the opening and closing member 50 for black is pushed upward from the valve closing position toward the valve opening position. By the upward movement of the opening and closing member 50 for black, the opening and closing valve 19 arranged in the discharge path for black is opened. The airtight space 46 is communicated only with the pump 38, and both of the closed space 63 for black and the closed space 63 for colors are not communicated with the atmosphere and the pump 38 and held in the shut-off state. In the position I, the pump 38 is driven, and the bubbles collected in the bubble collecting chamber 12 for black are discharged to the atmosphere through the discharge path 17, the airtight space 46, the switching path and the pump 38. In this discharging procedure, the closed space 63 for black and the closed space 63 for colors are held in the shut-off state.

If the discharge of the bubbles collected in the bubble collecting chamber 12 for black by the pump 38 is completed, the cam 55 and the switching member 73 are moved to the position J. During this movement, the slider 52 for black is returned rightward, whereby the opening and closing member 50 is retuned to the valve closing position, and the opening and closing valve 19 for black is closed. Also, the slider 52 for colors is moved leftward, and the opening and closing valves 50 for colors are pushed upward from the valve closing position toward the valve opening position, whereby the three opening and closing valves 19 for colors which are arranged in the discharge paths 17 for colors are opened. Also, as in the case of the position I, the airtight space 46 is communicated only with the pump 38, and both of the closed space 63 for black and the closed space 63 for colors are not communicated with the atmosphere and the pump 38 and held in the shut-off state. Further, in the position J, the pump 38 is driven, and the bubbles collected in the bubble collecting chambers 12 for colors are discharged to the atmosphere through the discharge paths 17, the airtight space 46, the switching paths and the pump 38. Also, in this discharging procedure, the closed space 63 for black and the closed space 63 for colors are held in the shut-off state. Thereafter, the cam 55 and the switching member 73 are moved to the position A. During this movement, the slider 52 for colors which is held in the valve opening state is returned rightward, and the opening and closing members 50 for colors are returned to the valve closing position, whereby the opening and closing valves 19 for colors are closed. In this way, operation for discharging bubbles collected in the bubble collecting chambers 12 is completed. During this bubble discharging procedure, the carriage 3 is held in the origin position.

Thereafter, the cam 55 and the switching member 73 are rotated to the position B, and the carriage lock 100 is lowered to release the state (locking state) for restraining the movement of the carriage 3. Also, in this position B, the communication or shut-off of the airtight space 46 and the closed space 63 is effected in the same manner as the position A. If the locked state by the carriage lock 100 is released, the carriage 3 is moved from the origin position to the idle suction position, and the discharge cap 40 and the nozzle cap 60 are separated from the lower surface of the carriage 3. Next, the cam 55 and the switching member 73 are moved to the position G, the depression for black, of the nozzle cap 60, is communicated only with the pump 38, and the depression of the discharge cap 40 and the depression for colors, of the nozzle cap 60, are shut off from the pump 38. During the rotation of the cam 55 and the switching member 73 toward the position G, the wiper 90 is raised from the retracted position to the wiping position and is held in the wiping position due to engagement of the engagement projection 94 with the engagement part 93. At this time, the carriage 3 is positioned rightward of the wiper 90 (toward the origin position).

In this state, the carriage 3 is moved leftward. During this movement, the nozzle surfaces on the lower surface of the carriage 3 are slidingly moved on the upper edge of the wiper 90, whereby ink attached to the nozzle surfaces is wiped off by the wiper 90. Then, if the wiping operation is finished as the carriage 3 passes the wiper 90, the carriage 3 is once stopped at the wiping finish position. Thereafter, the carriage 3 is returned to the idle suction position (toward the origin position). At this time, as the carriage 3 is brought into contact with the upper end of the wiper 90 from the left side, the wiper 90 is lowered from the wiping position to the retracted position. After the wiper 90 is lowered, the carriage 3 is stopped at the idle suction position.

Thereupon, the cam 55 and the switching member 73 are rotated to the position H. At this time, the carriage 3 is held in the idle suction position. Since the discharge cap 40 is not brought into contact with the carriage 3, the airtight space 46 is not defined, and the depression of the discharge cap 40 is communicated with the pump 38. If the pump 38 is driven, idle suction operation is implemented, by which the ink sucked along with the bubbles (air) from the bubble collecting chamber 12 into the discharge cap 40 in the discharge operation, is sucked into the pump 38 to be discharged to the atmosphere. In this way, the idle suction operation is completed.

Thereafter, the cam 55 and the switching member 73 are rotated to the position L. Thereupon, both of depressions of the nozzle caps for black and colors are opened to the atmosphere and communicated with the pump 38. The depression of the discharge cap 40 is not communicated with the pump 38. In this state, the carriage 3 is returned from the idle suction position to the origin position. By this fact, the discharge cap 40 is brought into tight contact with the carriage 3 to define the airtight space 46 (which is shut off from the atmosphere), and the nozzle cap 60 is brought into tight contact with the carriage 3 to define the closed spaces 63. After that, the cam 55 and the switching member 73 are returned to the position A(M). In this way, the discharging operation and the idle suction operation are completed.

<Ink Purge Process in Maintenance Position>

In an initial stage of an ink purge procedure for sucking and discharging ink clogging the nozzles of the printing heads 10 and the bubbles contained in the ink, the carriage 3 is locked to the origin position, and the airtight space 46 and the closed spaces 63 are defined. Also, the cam 55 and the switching member 73 are held in the position A of FIG. 22, and both of the closed spaces 63 for black and colors are opened to the atmosphere by way of the switching member 73 and communicated with the pump 38. The airtight space 46 is not communicated any one of the atmosphere and the pump 38 and held in the shut-off state.

In this state, the cam 55 and the switching member 73 are rotated to the position F. Then, both of the closed spaces 63 for black and colors are shut off from the atmosphere and are not communicated with the pump 38. The airtight space 46 is also shut off from the atmosphere and the pump 38. In this state, as the pump 38 is driven, a negative pressure is charged in the pump 38 and the switching member 73 (the interiors of the pump 38 and the switching member 74 are reduced in their pressure to no greater than the atmospheric pressure).

Thereafter, the cam 55 and the switching member 73 are rotated to the position G. Then, the closed space 63 for black is communicated with the pump 38 by way of the switching member 73, by which the black ink collected in the closed space 63 for black (that is, the nozzle cap 60) is sucked into the pump 38. At this time, the airtight space 46 and the closed space 63 for color are shut off from the pump 38 and the atmosphere.

If the purge of the ink existing in the closed space 63 for black is completed, the cam 55 and the switching member 73 are rotated to the position H, by which only the airtight space 46 is communicated with the pump 38, and both of the closed spaces 63 for black and colors are not communicated with the pump 38 and shut off from the atmosphere.

Thereafter, the carriage 3 is once moved from the origin position to the idle suction position and then moved to the printing region 8. At this time, while the cam 55 and the switching member 73 are rotated from the position A to the position F as described above, the wiper 90 which is held in the retracted position is raised and locked to the wiping position to be in a standby state for the wiping operation. Accordingly, while the carriage 3 is moved, the nozzle surfaces of the printing heads 10 are brought into contact with the wiper 90, and the ink attached to the nozzle surfaces are wiped off. Also, after the carriage 3 passes the wiper 90, flushing is implemented.

Thereafter, the carriage 3 is returned to the idle suction position. During this returning movement, the carriage 3 is brought into contact with the wiper 90, by which the wiper 90 is lowered from the wiping position to the retracted position. Also, in a state in which the carriage 3 is returned to the idle suction position, since the discharge cap 40 and the nozzle cap 60 are held separated from the lower surface of the carriage 3, the airtight space 46 and the closed spaces 63 are not defined.

Thereafter, the cam 55 and the switching member 73 are rotated from the position H to the position G, by which only the depression of the nozzle cap 90 for black is communicated with the pump 38. And, in this state, as the pump 38 is driven, the black ink existing in the closed space 63 for black is sucked by the pump 38 and the removed. In this way, the purge operation for black ink is conducted.

Thereafter, the cam 55 and the switching member 73 are rotated to the position L, by which the depressions of the closed spaces 63 for black and colors are opened to the atmosphere and communicated with the pump 38. Also, the depression of the discharge cap 40 is not communicated with the pump 38. In this state, as the pump 38 is driven, the idle suction operation is implemented again. By this fact, the ink remaining in the switching path among the switching paths 74 which is communicated with the atmospheric ports is sucked by the pump 38 and then removed.

Thereafter, the carriage 3 which is held in the idle suction position is returned to the origin position, and the airtight space 46 and the closed space 63 are defined. Then, the cam 55 and the switching member 73 are rotated to the position A(M). In this way, the purge operation for black ink is completed.

Further, the purge operation for color ink is implemented in the same manner as described above. In the purge operation for color ink, the positions F, G and H from the charge of a negative pressure to the completion of suction in the purge operation for black ink are implemented are changed to the positions C, D and E, respectively. The idle suction position G after wiping is changed to the position D.

In the above procedure, while the charge of a negative pressure is implemented before purging the ink so that the ink is sucked at a time, it can be envisaged that the ink purging operation can be implemented without implementing a negative pressure charging operation. In this case, the process in which the carriage 3 is stopped at the position F (in the case for colors, the position C) to implement the sucking operation by the pump 38 is omitted.

<Process in Which Carriage 3 Starts to Print Data on Printing Medium>

In a state in which the carriage 3 is held in the origin position after the maintenance is completed, if the carriage 3 is moved through the idle suction position and the wiping completion position toward the printing position 8 to print data on a non-printing medium, wiping of the nozzle surfaces is not needed. In this regard, an unnecessary wiping member that a useful life of the nozzle surfaces of the printing heads 10 is shortened.

In this case, before driving the carriage 3, the cam 55 which is held in the position A is moved to a position which passes the position J, for example, to a position between the positions L and M. While the cam 55 is moved from the position J to the position L, the releasing part 97*c* of the cam 55 interferes with the wiper 90 which is locked to the wiping position to lower the wiper 90 to the retracted position. In this state, even when the carriage 3 is moved from the origin position toward the printing region 8, the carriage 3 is not brought into contact with the wiper 90, whereby unnecessary wiping operation can be avoided.

Effects of Embodiment (1) When discharging the bubbles (air) collected in the bubble collecting chambers 12, the discharge cap 40 is brought into tight contact with the carriage 3 to define the airtight space 46, the opening and closing valves 19 are opened by the opening and closing members 50 to communicate the bubble collecting chambers 12 with the airtight space 46, and the air existing in the airtight space 46 is sucked by the pump 38 to be discharged to the atmosphere. Accordingly, during discharge of the bubbles, air flows from the bubble collecting chambers 12 through the airtight space 46 and the pump 38 to the atmosphere to constitute a unidirectional flow pattern. By this fact, the possibility of outside air to enter the bubble collecting chambers 12 and ink paths is eliminated, and it is possible to prevent air from being entrained in the ink.

Also, when compared to the method in which a negative pressure is induced from the nozzle side of the printing head 10 to suck ink and thereby remove bubbles entrained in the ink, in the present invention, it is possible to avoid waste of ink and to shorten a time for removing bubbles.

(2) Due to the fact that the valve opening operation of the opening and closing valves 19 by the opening and closing members 50 is effected in a state in which the discharge cap 40 is brought into tight contact with the carriage 3 to define the airtight space 46, as the discharge paths 17 of the bubbles are shut off from the atmosphere, entrainment of atmospheric air into the bubble collecting chambers 12 is prevented. By this fact, it is possible to prevent the ink from overflowing from the printing heads 10 due to pressure rises in the bubble collecting chambers 12.

(3) In the case that the bubble collecting chambers 12 have pressures which are lower than the atmospheric pressure and there exist water head differences between the printing heads 10 and the ink tanks 5, if the opening and closing valves are opened while the airtight space 46 has the atmospheric pressure, the air existing in the airtight space 46 is introduced into the bubble collecting chambers 12 to increase pressures of the bubble collecting chambers 12, and ink flows backward from the printing heads 10 to the ink tanks 5. However, in this embodiment of the present invention, because the opening and closing valves 19 are opened in a state in which a negative pressure is induced in advance in the airtight space 46, the bubble collecting chambers 12 are maintained at the negative pressure, and the ink is prevented from flowing backward toward the ink tanks 5.

(4) Due to the fact that each of the opening and closing members 50 has a shape of a rod which passes through the discharge cap 40 and the discharge cap 40 is formed of silicon rubber, airtightness of the airtight space 46 is ensured, and sliding resistances between the discharge cap 40 and the opening and closing members 50 can be decreased.

(5) If the bubbles are discharged with the printing heads 10 opened to the atmosphere, meniscuses are likely to be destroyed due to falls in pressures of the bubble collecting chambers 12. However, in this embodiment of the present invention, since discharge of the bubbles is implemented in a state in which the printing heads 10 are shut off from the atmosphere due to tight contact of the nozzle cap 60 with the carriage 3, it is possible to prevent the meniscuses from being destroyed.

(6) In this embodiment of the present invention, two kinds of printing heads 10 for black and colors are provided. Therefore, if the plurality of printing heads 10 are provided, when discharging the bubbles collected in the bubble collecting chambers 12, the printing heads 10 may possess different discharge resistances which are measured between the bubble collecting chambers 12 and the outlets 18, due to differences in the number of nozzles, diameter of the nozzle, and diameter of the ink path, and length of the ink path. In this case, if the bubble discharging operation is simultaneously implemented for the two kinds of printing heads 10 having different discharge resistances, a deviation may be caused in bubble discharge amounts of the respective printing heads 10. In this consideration, in this embodiment of the present invention, since discharge of the bubbles by the pump 38 is independently implemented for each of the printing head 10 for black and the printing heads 10 for colors, it is possible to prevent a deviation from being caused in bubble discharge amounts of the respective printing heads 10.

(7) Because the three printing heads 10 for colors are the same in the number of nozzles, diameter of the nozzle, diameter of the ink path, and length of the ink path, when discharging the bubbles collected in the bubble collecting chambers 12, the printing heads 10 possess the same discharge resistance from the bubble collecting chambers to the outlet 18. As a consequence, in this embodiment of the present invention, due to the fact that discharge of the bubbles is simultaneously implemented for the three printing heads 10 for colors, which possess the same discharge resistance, it is possible to constantly maintain a bubble discharge amount in the respective printing heads 10 and efficiently discharge the bubbles.

(8) The switching member 73 for switching the airtight space 46 between a state in which the airtight space 46 is communicated with the pump 38 and a state in which the airtight space 46 is shut off from the pump 38, and the cam 55 for moving each of the opening and closing members 50 between a valve opening position in which the opening and closing valve 19 is opened and a valve closing position in which the opening and closing valve 19 is closed, are configured to be simultaneously operated. By this fact, the operation for opening and closing the opening and closing valve 19 by the opening and closing member 50 moved due to operation of the cam 55 and the operation for sucking bubbles by the pump 38 switched by the switching member 73 can be implemented with precise timing. That is to say, since a separate mechanism for synchronizing the operation of the opening and closing member 50 and the bubble suction operation is not needed, structural simplification can be ensured.

(9) Moreover, since the switching member 73 can switch the closed space 63 between a state in which the closed space 63 is communicated with the pump 38 and a state in which the closed space 63 is shut off from the pump 38, in addition to the operation of the opening and closing member 50 and the bubble suction operation, the operation for sucking ink which blocks a passage defined in the nozzle can be implemented with precise timing.

(10) The opening and closing members 50 which are moved by the cam 55 between the valve opening position in which the opening and closing valve 19 is opened and the valve closing position in which the opening and closing valve 19 is closed, the wiper 90 which is operated by the cam 55 between a position in which the wiper 90 can wipe ink attached to the nozzle of the printing head 10 and a position in which the wiper 90 is not brought into contact with the nozzle of the printing head 10, and the carriage lock 100 for holding by virtue of the cam 55 the carriage 3 in the origin position (that is, the maintenance position) in which the bubbles can be discharged from the bubble collecting chambers 12, are located on an upper surface opposite to the switching member 73 with the partition wall 55*a* interposed therebetween. By this fact, the task for laying out on the lower surface of the partition wall 55*a* tubes which extend from the ports of the cover 76 for the switching member 73 to the pump 38, the airtight space 46, and the closed space 63, can be easily conducted.

(11) When the cam 55 is stopped immediately after driving the driven parts such as the opening and closing members 50 and so forth, due to loads applied to the cam 55 from the driven parts, the cam 55 is likely to be stopped at a position which is deviated from a predetermined position. To cope with this problem, in this embodiment of the present invention, the switching member 73 is received in the cover 76 which has the ports 78 through 82 for discharging and sucking air, has the switching paths 74 which can be communicated with the ports 78 through 82 of the cover 76, and can be slidingly rotated on the inner surface of the cover 76 while maintaining airtightness. In this way, since the switching member 73 which is rotated integrally with the cam 55 is configured to generate frictional resistance due to sliding rotation with respect to the cover 76, by the presence of the frictional resistance, it is possible to reliably stop the valve bodies 20 and the cam 55 at predetermined positions.

(12) In order to fix the positions of the ports 78 through 82 with respect to the switching member 73 which rotates, the cover 76 must be certainly restrained from being rotated. In this consideration, in this embodiment of the present invention, as a rotation restraining member, the shaft 33 of the sun gear 32 for rotatingly driving the switching member 73 and the cam 55 is used. Therefore, when compared to the case of providing the dedicated fixing member, structural simplification can be ensured. Also, since the cover 76 is held engaged by the engagement clips 83, the cover 76 can be relatively rotated with respect to the cam 55. Accordingly, rotation of the cam 55 and the switching member 73 is not adversely affected.

(13) Each of the opening and closing members 50 can be moved from the valve closing position in which the opening and closing valve 19 is closed, to the valve opening position in which the opening and closing valve 19 is opened, while being inserted into the discharge path 17 in an upward direction which is crossed with the moving direction of the carriage 3. Thus, if the carriage 3 is moved toward the origin position (the maintenance position) while the opening and closing member 50 is moved toward the valve opening position, the opening and closing member 50 interferes with the movement of the carriage 3. In this consideration, in this embodiment of the present invention, when the carriage 3 is in the printing region 8 for printing data on the printing medium, the opening and closing member 50 is held in the valve closing position, and when the carriage 3 is moved to the origin position (the maintenance position) for discharging the bubbles, the opening and closing member 50 is allowed to be moved to the valve opening position. By this fact, the carriage 3 is prevented from interfering with the opening and closing member 50 which is moved toward the valve opening position.

(14) While the carriage 3 is moved from the printing region 8 toward the origin position (the maintenance position), the carriage 3 pushes the discharge cap 40 which is in the standby position, to the tight contact position. Hence, although the member for synchronizing the movement of the carriage 3 with the movement of the discharge cap 40 is not provided, if the carriage 3 is moved toward the maintenance position, in conformity with the movement of the carriage 3, it is possible to bring the discharge cap 40 into tight contact with the carriage 3 with proper timing. Also, since the carriage 3 is configured to push the discharge cap 40, a dedicated driving source for moving the discharge cap 40 is not needed.

(15) While the carriage 3 is moved from the printing region 8 toward the origin position (the maintenance position), the carriage 3 pushes the nozzle cap 60 which is in the standby position, to the tight contact position. Hence, although the member for synchronizing the movement of the carriage 3 with the movement of the nozzle cap 60 is not provided, if the carriage 3 is moved toward the maintenance position, in conformity with the movement of the carriage 3, it is possible to bring the nozzle cap 60 into tight contact with the carriage 3 at proper timing. Also, since the carriage 3 is configured to push the nozzle cap 60, a dedicated driving source for moving the nozzle cap 60 is not needed.

(16) The home position (the origin position) of the carriage 3 is defined at a maintenance side when viewed from the position of the wiper 90 and corresponds to the maintenance position. In this case, when the carriage 3 which is held in the home position after maintenance is finished is moved toward the printing region 8 for printing data on the printing medium, wiping operation is not necessary. In this consideration, in this embodiment of the present invention, as a member for returning the wiper 90 from the wiping position to the retracted position, separately from the member due to the interference by the carriage 3, the releasing part 97*c* is provided to the cam 55. The releasing part 97*c* is engaged with the wiper 90 to move the wiper 90 from the wiping position to the standby position. By this fact, before the carriage 3 is moved toward the printing region 8, it is possible to move the wiper 90 from the wiping position to the retracted position by the releasing part 97*c* operated through driving of the cam 55. As in this case, if it is not necessary to wipe the printing head 10 using the wiper 90, by withdrawing the wiper 90 in advance to the retraced position, unnecessary contact of the wiper 90 with the printing head 10 is avoided, whereby durability of the printing head 10 can be improved.

(17) The releasing part 97*c* is configured to push the wiper 90 in a direction substantially parallel to the moving direction of the carriage 3 to thereby disengage the wiper 90 from the engagement part 93. In other words, as the member for returning the wiper 90 to the retracted position, in the same manner as the case in which the carriage 3 interferes with the wiper 90, the releasing part 97*c* pushes the wiper 90 in a direction in which the wiper 90 is disengaged from the engagement part 93. Accordingly, since it is not necessary to define in the cam 55 a guide path for forcibly moving the wiper 90 to the retracted position, the structural simplification of the cam 55 can be ensured.

(18) The cam 55 is configured to be rotatingly driven by a gear mechanism which is meshed with a rotation driving mechanism for feeding paper. Namely, the cam 55 and the rotation driving mechanism for feeding paper have the same driving source, whereby structural simplification can be further ensured.

(19) Because the cam 55 for moving the wiper 90 also serves as the member for moving the opening and closing members 50 and the member for moving the carriage lock 100, structural simplification can be still further ensured.

(20) The maintenance frame 111 is provided with a stopper 92 so that the wiper 90 can be intervened between the stopper 92 and the engagement part 93. Due to this fact, while the carriage 3 is moved toward the origin position (the maintenance position), when the carriage 3 interferes with the wiper 90 which is in the wiping position and moves the wiper 90 in a direction in which the wiper 90 is disengaged from the engagement part 93, the wiper 90 is brought into contact with the stopper 92 to be prevented from being excessively moved. As a consequence, it is possible to prevent other component elements from unnecessarily interfering with the wiper 90.

(21) Since the wiper 90 is held in the wiping position in which the wiper 90 is engaged with the engagement part 93 by virtue of the biasing member (the spring 95), it is possible to reliably hold the wiper 90 in the wiping position.

(22) The direction in which the wiper 90 is biased by the spring 95 is downwardly inclined in a direction in which the wiper 90 is moved from the wiping position to the retracted position. By this fact, since the spring 95 also serves as the biasing member for holding the wiper 90 engaged with the engagement part 93, it is possible to decrease the number of component elements.

Other Embodiments

The present invention is not limited to the above-described technique and the embodiment explained with respect to the drawings. For example, the following embodiments also fall within the scope of the present invention. Therefore, various modifications and changes can be made without departing from the scope and spirit of the present invention.

(1) In the above embodiment, before the discharge cap is brought into tight contact with the carriage to define the airtight space, the valve opening operation for the opening and closing valves by the opening and closing members may be implemented.

(2) In the above embodiment, the opening and closing valves may be opened with the airtight space maintained at the atmospheric pressure.

(3) In the above embodiment, the discharge cap may be formed of a material other than silicon rubber, and a rubber seal may be arranged in a region in which the discharge cap and the opening and closing members are brought into sliding contact with each other.

(4) In the above embodiment, the bubble discharging operation may be implemented with the printing heads opened to the atmosphere.

(5) In the above embodiment, the bubble discharging operation may be simultaneously implemented for the plurality of printing heads having different discharge resistances.

(6) In the above embodiment, the bubble discharging operation may be independently implemented for the plurality of printing heads having the same discharge resistance.

(7) In the above embodiment, after independently moving the switching member and the cam, their movement may be synchronized with each other.

(8) In the above embodiment, the switching member and the cam may be configured to be slid without rotation.

(9) In the above embodiment, the switching member may be formed of a material other than rubber, and a rubber member may be attached to the outer surface of the switching member or the inner surface of the cover as a separate component element.

(10) In the above embodiment, as the member for restraining the rotation of the cover, in place of the shaft of the gear, the arm of the cover may be fitted with a dedicated rotation restraining member.

(11) In the above embodiment, the engagement clips may be formed on the cover or both of the cover and the cam.

(12) In the above embodiment, the discharge cap may be moved by other dedicated member than the carriage.

(13) In the above embodiment, the nozzle cap may be moved by other dedicated member than the carriage.

What is claimed is:

1. An ink jet printer comprising:

a carriage movable on a body frame, including at least one printing head that prints data on a printing medium by jetting ink through a nozzle;

an ink tank that stores the ink to be supplied to a printing head; and an ink path that supplies the ink from the ink tank to the printing head, wherein the carriage has a bubble collecting chamber that collects bubbles produced in the ink path, a discharge path which is communicated with the bubble collecting chamber, and an opening and closing valve which is arranged in the discharge path and is normally closed, and wherein the body frame has an opening and closing member for opening and closing the opening and closing valve, a discharge cap which can be brought into tight contact with the carriage to close an outlet of the discharge path so that an airtight space communicated with the outlet is defined between the discharge cap and the carriage, and a suction member that sucks air from the airtight space; wherein the opening and the closing member is movable with respect to the discharge cap.

2. The ink jet printer according to claim 1, wherein valve opening operation of the opening and closing valve by the opening and closing member is implemented in a state in which the discharge cap is brought into tight contact with the carriage and thereby the airtight space is defined between the discharge cap and the carriage.

3. The ink jet printer according to claim 2, wherein the valve opening operation of the opening and closing valve by the opening and closing member is implemented in a state in which a negative pressure is induced by the suction member in the airtight space defined due to the tight contact of the discharge cap with the carriage.

4. The ink jet printer according to claim 1, wherein the opening and closing member is formed in a rod shape, wherein the opening and closing member passes through the discharge cap, and wherein the discharge cap is formed of silicon rubber.

5. The ink jet printer according to claim 1, wherein a nozzle cap which can be brought into tight contact with the carriage to cover the nozzle of the printing head is provided, and wherein discharge of bubbles by the suction member is implemented in a state in which the printing head is shut off from the atmosphere due to the tight contact of the nozzle cap with the carriage.

6. The ink jet printer according to claim 5, wherein the carriage is movable between the printing region for printing data on the printing medium and the maintenance position for discharging bubbles from the bubble collecting chamber, wherein the nozzle cap is movable between a tight contact position in which the nozzle cap is brought into tight contact with the carriage and a standby position in which the nozzle cap is not brought into contact with the carriage, and wherein the carriage is configured to move the nozzle cap from the standby position to the tight contact position while the carriage is moved from the printing region to the maintenance position.

7. The ink jet printer according to claim 1, wherein the carriage has a plurality of printing heads, wherein each printing head has a discharge path which extends from a bubble collecting chamber to an outlet, wherein each discharge path has a different bubble discharge resistance when bubbles collected in the bubble collecting chamber are discharged, and wherein discharge of bubbles by the suction member is independently implemented for each printing head.

8. The ink jet printer according to claim 7, wherein the printing heads includes a first printing head having a first bubble discharge resistance and a second printing head having a second bubble discharge resistance, and wherein the first bubble discharge resistance is lower than the second bubble discharge resistance.

9. The ink jet printer according to claim 8, wherein the first printing head is used for black, and the second printing head is used for colors.

10. The ink jet printer according to claim 1, wherein the carriage has a plurality of printing heads, wherein each printing head has a discharge path which extends from a bubble collecting chamber to an outlet, wherein each discharge path has a same bubble discharge resistance when bubbles collected in the bubble collecting chamber are discharged, and wherein discharge of bubbles by the suction member is simultaneously implemented for the plurality of printing heads.

11. The ink jet printer according to claim 1, wherein a switching member switches the airtight space between a state in which the airtight space is communicated with the suction member and a state in which the airtight space is shut off from the suction member, wherein a cam moves the opening and closing member between a valve opening position in which the opening and closing valve is opened and a valve closing position in which the opening and closing valve is closed, and wherein the switching member and the cam are configured to be simultaneously operated.

12. The ink jet printer according to claim 11, wherein a nozzle cap which can be brought into tight contact with the carriage to cover the nozzle of the printing head so that a closed space facing the printing head is defined between the nozzle cap and the carriage is provided, and wherein the switching member is configured to switch the closed space between a state in which the closed space is communicated with the suction member and a state in which the closed space is shut off from the suction member.

13. The ink jet printer according to claim 11, wherein a wiper is operated by the cam between a position in which the wiper can wipe ink attached to the nozzle of the printing head and a position in which the wiper is not brought into contact with the nozzle of the printing head, wherein a carriage lock holds by the cam the carriage in a maintenance position in which the bubbles can be discharged from the bubble collecting chamber, wherein the opening and closing member, the wiper and the carriage lock are located on one surface of a partition wall, and wherein the switching member is located on the other opposite surface of the partition wall.

14. The ink jet printer according to claim 11, wherein the switching member is covered by a cover, wherein the cover has a port that discharges and sucks air, wherein the switching member is configured to have a switching path which can be communicated with the port of the cover, and wherein the switching member is slidable on an inner surface of the cover while maintaining air tightness.

15. The ink jet printer according to claim 14, wherein the switching member and the cam are rotatingly driven by a gear, wherein the cover is held, through engagement by engagement clips, in a state in which the cover can be relatively rotated with respect to the cam and cannot be moved in an axial direction, and wherein the cover is prevented from being directly rotated by fitting an arm formed with the cover around a shaft of the gear.

16. The ink jet printer according claim 1, wherein the opening and closing member is configured to be capable of being moved from the valve closing position for closing the opening and closing valve to the valve opening position for opening the opening and closing valve while being inserted into the discharge path in a direction crossed with a direction in which the carriage is moved, wherein, when the carriage is in a printing region for printing data on the printing medium, the opening and closing member is held in the valve closing position, and wherein, when the carriage is moved to a maintenance position in which the bubbles can be discharged from the bubble collecting chamber, the opening and closing member is allowed to be moved to the valve opening position.

17. The ink jet printer according to claim 1, wherein the carriage is movable between the printing region for printing data on the printing medium and the maintenance position for discharging bubbles from the bubble collecting chamber, wherein the discharge cap is movable between a tight contact position in which the discharge cap is brought into tight contact with the carriage and a standby position in which the discharge cap is not brought into contact with the carriage, and wherein the carriage is configured to move the discharge cap from the standby position to the tight contact position while the carriage is moved from the printing region to the maintenance position.

18. The ink jet printer according to claim 8, wherein the discharge path is independent of the ink path.

19. The jet printer according to claim 1, wherein the opening and closing member is disposed in the discharge cap.

20. The ink jet printer according to claim 1, wherein the opening and closing member can be moved from the valve closing position for closing the opening and closing valve to the opening position for opening the opening and closing valve.

21. An ink jet printer comprising:

a carriage movable on a body frame, including a plurality of printing heads, each printing head printing data on a printing medium by jetting ink through a nozzle;

a plurality of ink tanks, each ink tank storing the ink to be supplied to a corresponding printing head; and a plurality of ink paths, each ink path supplying the ink from the ink tank to the corresponding printing head, wherein for each printing head the carriage has a bubble collecting chamber that collects bubbles produced in the respective ink path, a discharge path which is communicated with the bubble collecting chamber, and an opening and closing valve which is arranged in the discharge path and is normally closed, wherein each discharge path has a different bubble discharge resistance when bubbles collected in the bubble collecting chamber are discharged and wherein the body frame has an opening and closing member for opening and closing the opening and closing valve, a discharge cap which can be brought into tight contact with the carriage to cover an outlet of the discharge path so that an airtight space communicated with the outlet is defined between the discharge cap and the carriage, and a suction member that sucts air from the airtight space; wherein discharge of bubbles by the suction member is independently implemented for each printing head.

* * * * *

UNITED STATES PATENT AND TRADEMARK OFFICE

CERTIFICATE OF CORRECTION

PATENT NO. : 7,452,065 B2
APPLICATION NO. : 11/072278
DATED : November 18, 2008
INVENTOR(S) : Mikio Ogawa It is certified that error appears in the above-identified patent and that said Letters Patent is hereby corrected as shown below:

In Column 28, Claim 18, Line 1:
Please replace "claim 8" with --claim 1--.

In Column 28, Claim 21, Line 33:
Please replace "member that sucts" with --member that sucks--.

Signed and Sealed this

Eleventh Day of August, 2009

David J. Kappos

David J. Kappos
*Director of the United States Patent and Trademark Office*